US012234694B2

(12) United States Patent
Tiberi et al.

(10) Patent No.: US 12,234,694 B2
(45) Date of Patent: Feb. 25, 2025

(54) INNOVATIVE MULTIFUNCTION MANIPULATOR FOR MANIPULATING DRILLING ELEMENTS IN A DRILLING RIG AND RELATED DRILLING RIG

(71) Applicant: DRILLMEC S.P.A., Gariga di Podenzano (IT)

(72) Inventors: Andrea Tiberi, Magnolia, TX (US); Adolfo Basile, The Woodlands, TX (US)

(73) Assignee: DRILLMEC S.P.A., Gariga di Podenzano (IT)

( * ) Notice: Subject to any disclaimer, the term of this patent is extended or adjusted under 35 U.S.C. 154(b) by 0 days.

(21) Appl. No.: 18/246,511

(22) PCT Filed: Sep. 22, 2021

(86) PCT No.: PCT/IB2021/058623
§ 371 (c)(1),
(2) Date: Mar. 23, 2023

(87) PCT Pub. No.: WO2022/064372
PCT Pub. Date: Mar. 31, 2022

(65) Prior Publication Data

US 2023/0366277 A1 Nov. 16, 2023

(30) Foreign Application Priority Data

Sep. 24, 2020 (IT) ..... 102020000022483

(51) Int. Cl.
*E21B 19/15* (2006.01)
*E21B 19/00* (2006.01)
*E21B 19/16* (2006.01)

(52) U.S. Cl.
CPC ..... *E21B 19/155* (2013.01); *E21B 19/008* (2013.01); *E21B 19/161* (2013.01)

(58) Field of Classification Search
CPC .... E21B 19/155; E21B 19/008; E21B 19/161; E21B 19/14; E21B 19/15; E21B 19/165; E21B 19/16; E21B 19/18; E21B 19/20
(Continued)

(56) References Cited

U.S. PATENT DOCUMENTS 4,274,778 A 6/1981 Putnam et al.
9,453,377 B2 * 9/2016 Mosing ..... E21B 19/164
(Continued)

FOREIGN PATENT DOCUMENTS

EP 2799661 A2 11/2014
WO 2010/141231 A2 12/2010
(Continued)

OTHER PUBLICATIONS

Huber, Guenter, Electric Actuators in the Oil and Gas Industry, Jun. 18, 2019, Valve, p. 1-5 (Year: 2019).*
(Continued)

*Primary Examiner* — Lynn E Schwenning
(74) *Attorney, Agent, or Firm* — Merchant & Gould P.C.

(57) ABSTRACT

A multifunction manipulator includes a carriage; an articulated arm; a robotic apparatus; and a manipulation head. The robotic apparatus moves the manipulation head with at least three degrees of freedom. The manipulator moves the manipulation head with at least five degrees of freedom. The carriage includes a sliding block; a pulley-type hoisting device having a winch; an emergency braking system to prevent the carriage from moving due to malfunction of the hoisting system and to slide the carriage vertically. The articulated arm has a monolithic body constrained at a first end to the carriage, and at a second end to a first end of the robotic apparatus. The manipulation head connects to a second end of the robotic apparatus. The articulated arm includes first and second actuators. The articulated arm and
(Continued)

robotic apparatus have electric actuators controlled independently by a control system of the manipulator.

13 Claims, 13 Drawing Sheets

(58) Field of Classification Search
USPC ..... 414/22.51–22.71
See application file for complete search history.

(56) References Cited

U.S. PATENT DOCUMENTS

| | | | | |
|---|---|---|---|---|
| 11,591,863 | B2 * | 2/2023 | Basile | E21B 15/00 |
| 2007/0193750 | A1 | 8/2007 | Wright et al. | |
| 2014/0110174 | A1 | 4/2014 | Childers et al. | |
| 2018/0171760 | A1 * | 6/2018 | Zheng | G06F 16/29 |

FOREIGN PATENT DOCUMENTS

| | | | |
|---|---|---|---|
| WO | 2015/021558 | A1 | 2/2015 |
| WO | 2015/157815 | A1 | 10/2015 |
| WO | 2016/094022 | A1 | 6/2016 |
| WO | 2017/087349 | A1 | 5/2017 |
| WO | 2019/207493 | A1 | 10/2019 |
| WO | 2020/168377 | A1 | 8/2020 |

OTHER PUBLICATIONS

Electric Actuators in the Oil and Gas Industry (Year: 2019).*
International Search Report and Written Opinion for PCT/IB2021/058623 (Jul. 12, 2021).

* cited by examiner 60
62C
52
51
43
41
42
41
43
4
5
50
3
6
7
X
Y 3
42
43
41
43
5
62C
6
7
Z
Y
62B
62A
62B
52
60
51
4
41
6
7

6
7
60
62C
52
3
50
5
4
43
41
42
41
43
51
X
Y

INNOVATIVE MULTIFUNCTION MANIPULATOR FOR MANIPULATING DRILLING ELEMENTS IN A DRILLING RIG AND RELATED DRILLING RIG

This application is a National Stage Application of PCT/IB2021/058623 filed Sep. 22, 2021, which claims priority to application No. 102020000022483, filed Sep. 24, 2020, in Italy, and which applications are incorporated herein by reference. To the extent appropriate, a claim of priority is made to each of the above disclosed applications.

BACKGROUND OF THE INVENTION

The present invention relates to a multifunction manipulator capable of manipulating drilling elements, such as drill pipes or well protection elements, in different operating configurations of the drilling rig.

The present invention also relates to a manipulation system for drilling rigs, which can eliminate the human component from the drill floor and from the fingerboard where drilling elements are stored.

The present invention further relates to an innovative drilling rig comprising the manipulator and/or the manipulation system according to the present invention.

SUMMARY OF THE INVENTION

Drilling rigs are known which comprise a plurality of manipulators, each one suitably designed to perform a specific function in a specific area of the drilling rig.

Patent application WO2010141231A2 describes a system for transferring pipes, including tubular elements such as drill pipes and protection elements, from one location to another in the rig, particularly from the fingerboard to the well center.

It is also known from U.S. Pat. No. 4,274,778A to use two manipulators, one located in a specific position on the drill floor and the other located on the fingerboard, which cooperate in moving the pipes from the fingerboard to the well center.

Patent application WO2017087349 describes a plurality of different manipulators adapted to appropriately handle a large number of pipes in a big fingerboard.

Patent application WO2016094022 describes a manipulation system comprising a movable column on the drill floor, to which a plurality of manipulators are connected which permit reducing the number of human operators on the drill floor and on the fingerboard.

The above-described solutions are costly solutions that only permit handling drill pipes in some areas and/or for specific functions.

Such types of manipulators cannot carry out both "off-line" operations, i.e. operations to be executed during procedures not directly connected to drilling, such as assembling or disassembling a drill stand from ground level to the fingerboard or magazine, and the feeding operation necessary during the drilling process, wherein the drill pipes, e.g. in the form of a stand of pipes, are moved from the fingerboard or magazine to the well center or to the secondary well or mousehole, so that they can be picked up and used during the drilling phases, and vice versa. The individual manipulators currently implemented in drilling rigs have a limited number of degrees of freedom, since they are designed to perform only one specific function within the drilling rig. Such manipulators, except for any degrees of freedom of a manipulation head, have three degrees of freedom at most.

Patent application EP2799661A2 describes a manipulator for drilling rigs comprising an anthropomorphic robotic arm having a large number of degrees of freedom. Such type of manipulator cannot handle pipes for off-line operations, e.g. for assembling, disassembling and moving a stand of drilling elements.

A multifunction manipulator for handling drilling elements in a drilling rig is also known from patent application WO2019207493 by Drillmec Inc. The embodiment described and illustrated therein turns out to be unsafe, since it includes no safety system for the slide drive system, and inaccurate, since the illustrated arm construction solution cannot accurately control the movement and position of the first end of the robotic apparatus, in addition to being subject to inclination and bending, thus reducing the load capacity of the manipulator itself.

The present invention intends to solve all the above-mentioned technical problems as well as other technical problems known to a skilled person, in light of the solutions currently known in the art.

In particular, the present invention intends to provide an innovative multifunction manipulator capable of executing drill pipe handling operations both during the drilling phase and during the pipe assembling/disassembling phase, in particular during the off-line procedures of the drilling rig, in a safe manner and with high precision, thus allowing the manipulation of stands of drilling elements which are heavier that those that can be handled by prior-art solutions.

The present invention also intends to reduce the number of human operators, and in particular to eliminate the need for any of them, by automating the drilling-element handling process by means of an innovative manipulation system.

One aspect of the present invention relates to a multifunction manipulator having the features set out in the appended claim 1.

A further aspect of the present invention relates to a manipulation system having the features set out in the appended claim 9.

Yet another aspect of the present invention relates to a drilling rig having the features set out in the appended claim 12.

BRIEF DESCRIPTION OF THE DRAWINGS

The features and advantages of the manipulator, system and rig will become apparent in the light of the following description of some preferred embodiments and of the annexed drawings, wherein:

FIG. 2A shows a side view of the manipulator; whereas FIG. 2B shows a front view of the manipulator;

FIG. 3A shows a side view of the manipulator; whereas FIG. 3B shows a front view of the manipulator;

FIG. 4A shows a side view of the manipulator; whereas FIG. 4B shows a front view of the manipulator;

FIG. 5A shows a top view of the manipulator in a fourth operating configuration; FIG. 5B shows a top view of the manipulator in a fifth operating configuration; FIG. 5C shows an overlay front view of the manipulator in the fourth and fifth operating configurations, permitting a comparison between them;

FIG. 6A shows a side view of the manipulator in a sixth operating configuration; FIG. 6B shows an overlay side view of the manipulator in a seventh operating configuration and in the third operating configuration, permitting a comparison between them;

FIG. 7A shows an axonometric front view of the manipulator carriage only, with the first actuator of the articulated arm; FIG. 7B shows an axonometric view of the pulley comprised in the carriage hoisting system; FIG. 7C shows the pulley of FIG. 7B in a sectional view relative to a vertical plane;

FIG. 8A shows a perspective view of the articulated arm only, with the second actuator; FIG. 8B shows a perspective view of the robotic apparatus only;

FIG. 9A shows a front view of the manipulation head in a first embodiment; FIG. 9B shows a second embodiment of the clamps;

FIG. 10A shows the phase in which the multifunction manipulator grasps a drill pipe that has been placed on the drill floor by a lifting device or catwalk; FIG. 10B shows the positioning of a drill pipe in a secondary well or mousehole by the multifunction manipulator; FIG. 10C shows the positioning of a stand of drill pipes at the well center from two viewpoints, one illustrating the multifunction manipulator and the other illustrating the stabilization system; FIG. 10D shows the positioning of a stand of drill pipes in a housing of a fingerboard for stands of drill pipes from two viewpoints, one illustrating the multifunction manipulator and the other illustrating the stabilization system.

Figure 1B:
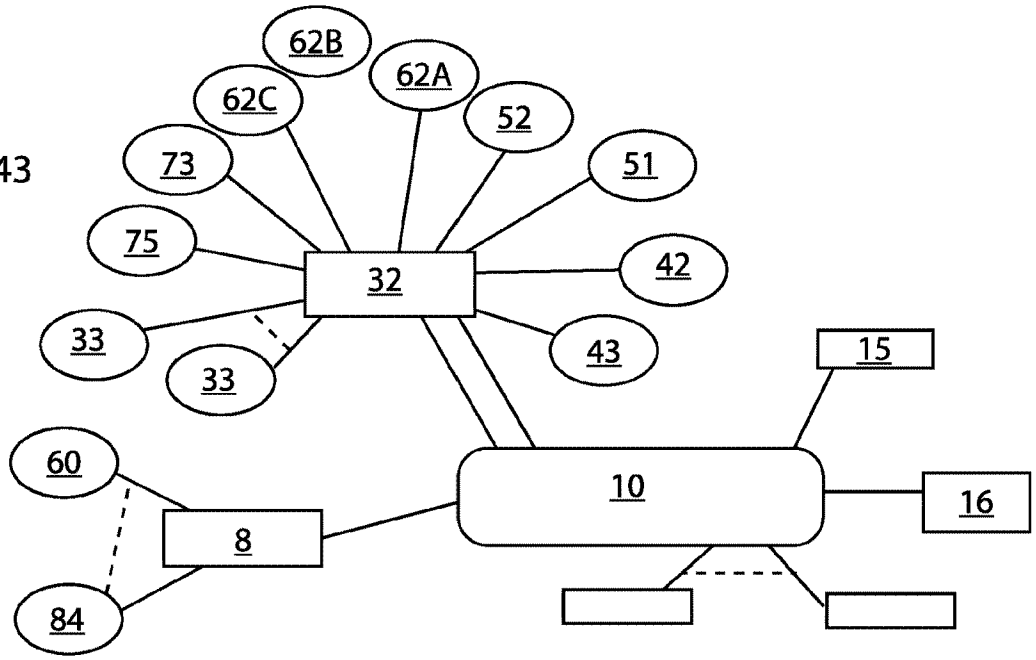
FIGS. 1A and 1B show, respectively, a perspective rear view of one possible embodiment of the manipulator according to the present invention in one possible operating configuration (FIG. 1A) and a schematic representation of the control system of the same manipulator (FIG. 1B)

With reference to the above-mentioned figures, reference numeral 3 designates as a whole the multifunction manipulator according to the present invention; whereas reference numeral 1 designates the drilling rig, in which the whole multifunction manipulator 3 is comprised.

Multifunction manipulator 3 is particularly suitable for manipulating drilling elements "P" in a drilling rig 1, in particular for assembling, disassembling and moving a stand "S" of drilling elements "P", both when such drilling elements "P" or stands "S" are substantially vertical and when they are substantially horizontal.

For the purposes of the present invention, the term drilling elements may refer to drill pipes, drill collars and heavyweight drill pipes, as well as to well casings, junction elements or subs and, more generally, to one or more elements substantially cylindrical in shape.

In the following, the term drilling elements will be used for simplicity's sake to refer, without distinction, to pipes, casings and/or subs, etc. used in drilling rigs, unless otherwise specified.

Manipulator 3 according to the present invention comprises a carriage 4; an articulated arm 5; a robotic apparatus 6; a manipulation head 7.

Said robotic apparatus 6 is adapted to move said manipulation head 7 with at least three degrees of freedom. Furthermore, said manipulator 3 according to the present invention is configured to move said manipulation head 7 with at least five degrees of freedom.

In the preferred embodiment of manipulator 3, said carriage 4 in turn comprises: at least one sliding block 41, preferably two; a pulley-type hoisting system 42, in turn comprising a winch 420 and an emergency braking system 43.

Said emergency braking system 43 is adapted to prevent carriage 4 from moving in the event of a malfunction of hoisting system 42.

Preferably, said pulley-type hoisting system 42 is adapted to cause said carriage 4 to slide vertically along a first axis "Z" parallel to the longitudinal extension of a mast 12 comprised in drilling rig 1. Said axis "Z" is preferably a vertical axis.

Preferably, said manipulation head 7 is adapted to at least grasp, hold and suitably release at least one drilling element "P".

Describing now more in detail the construction of manipulator 3 according to the present invention, said articulated arm 5 has a monolithic body 50. Such a solution permits increasing both the handling precision and the peak loads that can be withstood by manipulator 3.

Said articulated arm 5, in particular said body 50, is constrained, at a first end thereof, to said carriage 4, so that it can rotate about a horizontal axis; and, at a second end thereof, to a first end of said robotic apparatus 6, so that it can rotate about a horizontal axis. Such connections of arm 5 define the articulations allowing its movements, as well as some of the movements of manipulator 3.

As regards robotic apparatus 6, said manipulation head 7 is connected to the second end of robotic apparatus 6.

Describing the construction of articulated arm 5 in further detail, said articulated arm 5 comprises: a first actuator 51. Said first actuator 51 is adapted to move articulated arm 5 to allow moving robotic apparatus 6 along at least one second axis "X" perpendicular to said first axis "Z", along which said carriage 4 travels.

By means of such movement, said articulated arm 5 is adapted to assume at least two operating configurations, e.g. a retracted one and an extended one, and also, advantageously, any possible configuration in between.

Said articulated arm 5 further comprises a second actuator 52. Said second actuator 52 is adapted to move articulated arm 5 to allow keeping the first end of robotic apparatus 6 in line with an axis parallel to said first axis "Z".

Such a solution permits maintaining the verticality of the first end of robotic apparatus 6 in a simple manner and by means of a compact structure, not requiring the use of any additional actuator in robotic apparatus 6.

In a preferred, but merely illustrative and non-limiting, embodiment, said second end of articulated arm 5 is connected to the first end of robotic apparatus 6, so that, under the action of said second actuator 52, it can rotate about a horizontal axis. Such a solution permits maintaining the verticality of the first end of robotic apparatus 6 in any operating configuration of manipulator 3, e.g. in any operating configuration of articulated arm 5, e.g. also when said manipulator 3 is used for picking up and/or depositing a stand "S" of drilling elements "P" from/to a fingerboard 14 included in drilling rig 1.

In the preferred embodiment of manipulator 3 according to the present invention, said articulated arm 5 and said robotic apparatus 6 comprise electric actuators; even more preferably, said articulated arm 5 and said robotic apparatus 6 only comprise electric actuators. Such a solution permits increasing the precision of the individual movements allowed by the various degrees of freedom of articulated arm 5, of robotic apparatus 6 and, more in general, of manipulator 3.

Manipulator 3 according to the present invention further comprises a control system 32. Said control system 32 is adapted to independently control all the actuators, in particular the electric actuators, comprised in said articulated arm 5 and in said robotic apparatus 6. This solution allows manipulator 3 to be controlled with the utmost precision, thus ensuring optimal operability and accuracy over all the degrees of freedom of said manipulator 3.

As aforementioned, said robotic apparatus 6 is connected, at a first end thereof, to the second end of articulated arm 5. Said manipulation head 7 is connected to the second end of the robotic apparatus 6, so that said manipulation head 7 can be moved with at least three degrees of freedom. Moreover, said manipulator 3 according to the present invention is configured to move said manipulation head 7 with at least five degrees of freedom.

In general, manipulator 3 according to the present invention is designed to adapt itself to different requirements as concerns the handling of drilling elements "P", and is designed in a manner such that the peak forces acting upon manipulator 3 are always as small as possible, for the purpose of reducing any bending effects on the structure of manipulator 3 and/or on drilling elements "P", as well as on drilling rig 1 as a whole, while still ensuring the possibility of handling high loads. Furthermore, manipulator 3 is designed to ensure the utmost precision in the movements of manipulation head 7 while minimizing space occupation.

In a preferred embodiment of manipulator 3 according to the present invention, said first actuator 51 is a linear actuator. Said first actuator 51 is constrained, at a first end thereof, to body 50 of articulated arm 5 and, at a second end thereof, suitably constrained to carriage 4. Said second actuator 52 is a linear actuator constrained, at a first end thereof, to body 50 of articulated arm 5. At its second end, said second actuator 52 is suitably constrained to the first end of robotic apparatus 6.

In a preferred, but merely illustrative and non-limiting, embodiment, said first actuator 51 comprises an electric motor, suitably connected to a worm screw, and said first actuator 51 is designed to allow the horizontal movement along said second axis "X" of manipulator 3, by acting upon body 50 of articulated arm 5. In the same embodiment, said second actuator 52 comprises an electric motor, suitably connected to a worm screw, and said second actuator 52 is designed to stabilize articulated arm 5 during its motion and to maintain the verticality of the first end of robotic apparatus 6. Preferably, said first actuator 51 has better performance, including power, than said second actuator 52.

In a preferred, but merely illustrative and non-limiting, embodiment, said manipulator 3 comprises a plurality of sensors. Said sensors and the electric/electronic actuators comprised in manipulator 3 are electrically connected, monitored and/or controlled by control system 32 of manipulator 3. Said control system 32 is adapted to efficiently cooperate within the control architecture of drilling rig 1 in order to achieve the goal of manipulator 3, and more generally of drilling rig 1.

More in general, said electric/electronic actuators comprised in manipulator 3 preferably comprise high-performance reducers and servocontrols to ensure even movements and reliable operation of manipulator 3.

The driving of said robotic apparatus 6 by means of said articulated arm 5 allows said robotic apparatus 6 to assume at least two operating configurations. In particular, said robotic apparatus 6 assumes a first operating configuration, wherein said robotic apparatus 6 is proximate to said carriage 4, and a second operating configuration, wherein said robotic apparatus 6 is distant from said carriage 4, with reference to said second axis "X".

In a preferred, but merely illustrative and non limiting, embodiment of manipulator 3 according to the present invention, said robotic apparatus 6 comprises, at said first end, a slewing ring 60. Said slewing ring 60 is adapted to allow robotic apparatus 6 to rotate about a vertical axis 6, in particular relative to said articulated arm 5.

As previously specified, said second actuator 52 of articulated arm 5 is preferably designed to keep said slewing ring 60 in line with an axis parallel to said first axis "Z". Preferably, said second actuator 52 is constrained to a fixed portion of said slewing ring 60. Preferably, said second actuator 52 allows slewing ring 60 to lie in a horizontal plane, e.g. defined by the second axis "X" and by a third axis "Y", the latter being perpendicular to the first axis "Z" and to the second axis "X".

In one possible, but merely illustrative and non-limiting, embodiment, said slewing ring 60 comprises a rack, which is rotatably driven by an electric actuator, e.g. an electric motor.

In a preferred embodiment of manipulator 3 according to the present invention, said robotic apparatus 6 comprises a first electric actuator 62A, which is adapted to cause said manipulation head 7 to rotate, preferably to oscillate, about a first horizontal axis. Preferably, said first electric actuator 62A is located in proximity to said first end of robotic apparatus 6.

Said robotic apparatus 6 further comprises a second electric actuator 62B, preferably a linear one, adapted to cause said manipulation head 7 to oscillate relative to a second horizontal axis, wherein said second horizontal axis being parallel to said first horizontal axis. Preferably, said second electric actuator 62B is located in proximity to said second end of robotic apparatus 6.

In a preferred, but merely illustrative and non-limiting, embodiment, said second actuator 62B comprises an electric motor suitably connected to a worm screw, and said second actuator 62B is designed to act upon manipulation head 7 to move it about said second horizontal axis.

In addition, said robotic apparatus 6 comprises a third electric actuator 62C adapted to cause said manipulation head 7 to rotate about a first vertical axis, in particular through said slewing ring 60 comprised in robotic apparatus 6 at said first end of said robotic apparatus 6. In a preferred, but merely illustrative and non-limiting, embodiment, said third actuator 62C is adapted to rotatably drive said rack for rotating said slewing ring 60.

In a preferred, but non-limiting, embodiment of manipulator 3 according to the present invention, each one of said electric actuators (62A, 62B, 62C) comprises at least one electric motor, preferably of the brushless type.

More in general, said electric actuators (62A, 62B, 62C) are adapted to operate on three axes. Said three axes are distinct from one another. In particular, said electric actuators (62A, 62B, 62C) are adapted to operate on at least three different axes, thus providing manipulation head 7 with at least three different degrees of freedom.

In a preferred, but non-limiting, embodiment, said robotic apparatus 6 comprises a first portion, comprising said slewing ring 60, and a second portion. Preferably, said first portion is connected to articulated arm 5, in particular to the second end of articulated arm 5.

Said first portion of robotic arm 6 comprises, in turn, a fixed portion, adapted to be fixed to articulated arm 5, and a mobile portion. Said slewing ring 60 and said third electric actuator 62C allow said mobile portion to rotate relative to said fixed portion; as a consequence, said slewing ring 60 and said third electric actuator 62C allow manipulation head 7 to rotate, e.g. by +90° and −90° relative to a central position, about a vertical axis parallel to said first axis "Z".

Said second portion of robotic apparatus 6 is connected to the first portion, in particular to said mobile portion of the first portion.

Said second portion of robotic apparatus 6 is connected to said first portion of robotic apparatus 6 by means of a mechanism that can be driven by the first electric actuator 62A. Under the action of said first electric actuator 62A, said mechanism causes said manipulation head 7 to rotate, preferably to oscillate, about said first horizontal axis.

To the end of the second portion of robotic apparatus 6, corresponding to the second end of robotic apparatus 6, said manipulation head 7 is connected via a mechanism that can be operated by the second electric linear actuator 62B, which is adapted to cause said manipulation head 7 to oscillate relative to a second horizontal axis.

Said control system 32 is adapted to independently control the movements of said carriage 4, said articulated arm 5 and said robotized apparatus 6, for the purpose of allowing manipulator 3 to perform different functions, thus becoming a multifunction manipulator 3.

The use of electric actuators in both articulated arm 5 and robotic apparatus 6 provides faster, simpler and more reliable control over the handling and positioning of manipulation head 7, thus allowing manipulator 3 to become a multifunction manipulator, unlike the hydraulic solutions normally implemented in the manipulators according to the prior art. Moreover, the use of electric actuators makes it possible to simplify the assembling of said manipulator 3, thus reducing production costs and facilitating the designing of such manipulator 3, which, with the same number of degrees of freedom as a hydraulic manipulator, will be more agile, less bulky and altogether lighter.

As previously specified, said control system 32 comprised in said manipulator 3 is adapted to independently control the movements of carriage 4, of articulated arm 5 and of robotic apparatus 6, in addition to those of manipulation head 7.

Said control system 32 is, therefore, electronically connected to the various motors, actuators and/or systems comprised in manipulator 3 according to the present invention. Said control system 32 is preferably suitable for controlling entire manipulator 3 according to the present invention. Preferably, said control system 32 is electrically connected to a control unit 10 comprised in drilling rig 1, for the purpose of using manipulator 3 as required in the different operating phases of drilling rig 1.

In a preferred, but non-limiting, embodiment of said manipulator 3 according to the present invention, said manipulation head 7 comprises at least one clamp 72. In a preferred embodiment, said manipulation head 7 comprises two clamps 72, distinct from each other. Preferably, said two clamps 72 are so positioned as to be able to grasp one drilling element "P" in two distinct locations along the longitudinal axis of such drilling element "P".

Each clamp 72 is adapted to grasp, hold and suitably release different types of drilling elements "P". Each clamp 72 is preferably handled by a suitable handling device 73. Such handling device 73 is preferably controlled, when handling clamps 72, by said control system 32.

Preferably, said articulated arm 5, said robotic apparatus 6 and manipulation head 7 may comprise abutment elements adapted to define a mechanical limit for the relative movement between the parts, as concerns one or more degrees of freedom of manipulator 3.

Preferably, each clamp 72 comprises noses adapted to rotate about mutually parallel axes, in order to facilitate the handling and/or to allow grasping different types of drilling elements "P". Said noses can be handled by means of said handling device 73.

More in general, said handling device 73 is adapted to appropriately handle said clamps 72, spreading their noses to grasp, hold or suitably release a drilling element "P".

Said manipulation head 7 further comprises at least one rotation system 74. Said rotation system 74 is adapted to permit the rotation of drilling elements "P". Preferably, said rotation system 74 is arranged between the two clamps 72 comprised in manipulation head 7, with reference to the longitudinal axis of drilling element "P".

Said rotation system 74 allows the drilling elements that have been grasped by manipulation head 7 to rotate about their own longitudinal axes, while nevertheless keeping drilling element "P" under control. Such a solution allows rotating drilling elements "P" for assembling them in order to create a stand "S" or for disassembling such stand "S" in a safe manner. In particular, the embodiment wherein said rotation system 74 is arranged between the two clamps 72 permits a safe and controlled rotation of drilling element "P" without completely losing control over drilling element "P". Said pair of clamps 72 can be used for holding drilling elements "P" in position while said rotation system 74 allows drilling elements "P" to freely rotate as drilling elements "P" are mutually connected or disconnected, e.g. for assembling or disassembling a stand "S" of drilling elements "P". In a preferred, but merely illustrative and non-limiting, embodiment, said rotation system 74 comprises a plurality of rollers or wheels, preferably idle-mounted ones, which can rotate freely. More in particular, while assembling or disassembling a stand "S", rotation system 74 supports drilling elements "P" while allowing them to rotate. During this phase, clamps 72 are not tightened against drilling element "P", being at least partly open.

In a preferred embodiment of manipulation head 7, it comprises a safety system 75. Preferably, said safety system 75 comprises, in turn, a plurality of sensors. Said safety system 75, and in particular said sensors, are adapted to identify the correct position of said clamps 72 relative to drilling element "P". In a preferred, but merely illustrative and non-limiting, embodiment, said safety system 75 comprises a plurality of sensors, preferably at least three optical sensors. Said optical sensors are designed to identify the correct position of clamps 72 relative to drilling elements "P"; for drill pipes "P", for example, said optical sensors are adapted to ensure the proper alignment with the drill pipe and to prevent clamps 72 from acting upon the connection portion or tool joint of said drill pipes. Said optical sensors are, for example, proximity sensors and/or video cameras. In an even more preferable embodiment, said optical sensors comprise at least one video camera, e.g. located near at least one clamp 72, preferably on clamp assembly 72, so that it will move integrally with at least one clamp 72 and will always frame the operations area, thus providing visual feedback. Such visual feedback may be useful to an operator.

Said safety system 75 may further comprise at least one force sensor, e.g. at least one load cell, adapted to determine if at least one of clamps 72 has correctly grasped at least one drilling element "P", in addition to verifying the gripping action over time.

In a preferred embodiment, handling device 73, in particular the actuator used for moving said at least one clamp 72, is of the hydraulic type for appropriately handling said clamps 72.

At said at least one clamp 72 there is said at least one force sensor, e.g. a load cell, capable of determining if drilling element "P" has been grasped correctly. By way of example, if the force sensor detects an applied force of ON, this means that no drilling element "P" has been grasped by said clamps 72. Conversely, if the value reaches 120 kN, this means that clamps 72 have correctly grasped said drilling elements "P". Preferably, said force sensors, e.g. load cells, arranged on manipulation head 7 are designed and positioned in such a way as to determine a triangle of forces, so as to be able to determine if the load is balanced and provide an indication about the inclination of manipulation head 7.

In a preferred embodiment, said clamps 72 and said rotation system 74 can be easily replaced on said manipulation head 7, without changing handling device 73 and safety system 75. By changing clamps 72 and rotation system 74 it is possible to adapt, at low cost and in a simple and quick manner, manipulation head 7 to the size of drilling element "P" to be handled, thereby reducing the downtime of manipulator 3.

In one possible embodiment of manipulator 3 according to the present invention, said at least one sliding block 41 of carriage 4 is adapted to slide along guides 121 comprised on mast 12. Via said guides 121, manipulator 3 can move along said first axis "Z". The present embodiment permits associating manipulator 3 according to the present invention with any type of existing mast 12, and hence with any existing drilling rig 1.

In the preferred embodiment, said emergency braking system 43 of carriage 4 is adapted to act upon said guides 121 comprised on mast 12.

It is now apparent how manipulator 3 according to the present invention can safely and quickly broaden the functionality of a drilling rig 1.

In the preferred embodiment of said pulley-type hoisting system 42, it comprises a pulley 422, arranged on said carriage 4, and a pin 423. Pin 423 of the pulley 422 carries a load cell 424.

Said load cell 424 being connected to control system 32 of manipulator 3, thus making it possible to detect the weight applied to pin 423 of pulley 422. By way of non-limiting example, load cell 424 carried by pin 423 of pulley 422 arranged on carriage 4 allows identifying the weight of manipulator 3 and whether the latter is lifting one or more drilling elements "P", e.g. in the form of a stand "S" comprising two or three drilling elements "P".

Moreover, through said load cell 424 on pin 423 of pulley 422 it is possible to determine if there is anything preventing the movements of the manipulator, e.g. if manipulator 3 and/or one or more drilling elements "P" being handled by the manipulator 3 have gotten stuck somewhere.

Describing now more in detail one possible embodiment of hoisting system 42 of manipulator 3, it comprises, as already specified, a winch 420, preferably an electric one. Preferably, said winch 420 is mounted on the back of mast 12. In this embodiment, said hoisting system 42 further comprises a pulley-type system arranged on top of mast 12, above the crown block of said mast 12. Preferably, said winch 420 is arranged on the back of mast 12 in a vertical position, so that the ropes are run through such pulley-type system to connect to said pulley 422 on carriage 4.

Said emergency braking system 43 is preferably connected to control system 32 to prevent carriage 4 from falling in the event of a malfunction. Such malfunctions may be determined, for example, from a load variation detected on pin 423 of pulley 422 of carriage 4. Preferably, said emergency braking system 43 is of the failure-proof hydromechanical type.

More in general, depending on the motion imparted by hoisting system 42 in order to lift and/or lower said carriage 4 along said first axis "Z", said sliding blocks 41 of said carriage 4 are adapted to slide along said guides 121 comprised on mast 12. For example, said guides 121 are located in the front part, e.g. between the lateral faces of mast 12. Such guides 121 are preferably designed to allow carriage 4 to slide along the entire longitudinal extension of said mast 12. Preferably, said guides 121 are parallel to the guides that permit moving drill head 15 comprised in drilling rig 1.

More in general, said carriage 4 and hoisting system 42, as well as guides 121, are designed to not interfere with the devices already included in a drilling rig 1, such as, for example, drill head 15.

In a preferred, but merely illustrative and non-limiting, embodiment, the shape of said carriage 4 is so designed as to be able to accommodate, at least partly, the electronic and/or hydraulic controls for articulated arm 5, robotic apparatus 6 and manipulation head 7.

Said multifunction manipulator 3 is particularly suitable for being included in an assembly, in particular a manipulation system. Said manipulation system is particularly suitable for manipulating, in particular moving, one or more drilling elements "P". Said manipulation system is particularly suitable for being included in a drilling rig 1, particularly in drilling rigs 1 in the absence of human operators, at least on a drill floor 13 and/or on a fingerboard 14 of said drilling rig 1.

Said manipulation system comprises, in addition to the manipulator 3, a stabilization system 8. Such stabilization system 8 is not a robotic arm, as is normally the case in prior-art manipulation systems.

Said stabilization system 8 is adapted to slide along a guide 85. Said guide 85 is disposed on said drill floor 13.

Said stabilization system 8 cooperates with multifunction manipulator 3 according to the present invention in moving one or more drilling elements "P", e.g. in the form of stands "S".

Said stabilization system 8 comprises two independent arms (81, 82). Said arms (81, 82) are adapted to grasp and suitably release a first end of at least one drilling element "P" or of a stand "S" of drilling elements "P", while said manipulator 3 is adapted to grasp, hold and suitably release a second end of the same at least one drilling element "P" or of the same stand "S" of drilling elements "P".

Preferably, said manipulation system according to the present invention comprises a control unit, preferably the same control unit 10 comprised in drilling rig 1. More in general, said control unit is adapted to at least control the relative motion of said manipulator 3 and of said stabilization system 8 so as to obtain mutually coordinated movements.

In a preferred, but merely illustrative and non-limiting, embodiment of the manipulation system, stabilization system 8 is designed in a manner such that said guide 85 is a linear guide, e.g. a pair of rails. Preferably, said linear guide 85 extends on drill floor 13 and comprises a first end proximate to both a well (H, M), comprised in drill floor 13, and a mast 12, and a second end in a position remote from mast 12 of drilling rig 1. Preferably, said guide 85 is aligned with the direction in which lifting device or catwalk 16 arranges drilling elements "P" on drill floor 13.

Said stabilization system 8 is adapted to position itself in proximity to said second end of guide 85 in order to limit the hindrance that it may cause during the execution of the typical procedures of drilling rig 1. Moreover, such stabilization system 8 has compact dimensions, thus reducing the space occupation on drill floor 13.

Said stabilization system 8 is adapted to position itself in proximity to said first end of guide 85 in order to move drilling elements "P" to and from a well (H, M).

In a preferred embodiment of stabilization system 8, it comprises, in addition to said arms (81, 82): a slide 80 adapted to slide along said guide 85. Said arms (81, 82) are rotatably constrained, at a first end thereof, to slide 80. Said slide 80 being adapted to rotate, preferably to oscillate, about a vertical axis perpendicular to said guides 85. A roller 83 is rotatably constrained to the opposite end of each arm (81, 82). In particular, said roller is constrained to the corresponding arm in order to rotate, in particular to oscillate, relative to the respective arm (81, 82).

Each roller 83 is adapted to rotate idly about its own longitudinal axis.

Said stabilization system 8 comprises a plurality of actuators 84, preferably electric actuators, adapted to provide the various movements of slide 80, of both arms (81, 82) and of the respective rollers 83.

Said manipulator 3 and/or the manipulation system according to the present invention are particularly suitable for being comprised in a drilling rig 1.

Drilling rig 1 according to the present invention comprises a substructure adapted to be set at ground level where drilling will take place. Said drilling rig 1 according to the present invention further comprises a mast 12, which extends along a vertical axis parallel to said vertical first axis "Z", along which the longitudinal extension of mast 12 is defined. The same drilling rig 1 comprises a drill floor 13, set at a predefined height above the ground, on top of the substructure. Preferably, said mast 12 extends from said drill floor 13 Drilling rig 1 further comprises a drill head 15, which is adapted to slide along said mast 12. Mast 12 comprises, at a predefined height above drill floor 13, a fingerboard 14. In said fingerboard 14 a plurality of drilling elements "P" can be housed, preferably in the form of stands "S" of two or more drilling elements "P", so that they can be suitably grouped.

Drilling rig 1 according to the present invention comprises also a lifting device or catwalk 16. Said lifting device 16 is adapted to move drilling elements "P" from the ground level to drill floor 13, and vice versa.

Drilling rig 1 according to the present invention comprises at least one manipulator 3 and/or one manipulation system according to the present invention.

Drilling rig 1 according to the present invention advantageously comprises highly automated systems and circuits. The high level of automation of drilling rig 1 according to the present invention permits reducing the number of human operators required in the rig, particularly on drill floor 13 and/or on fingerboard 14. Said highly automated systems and circuits are, for example, systems for continuous mud circulation and systems for connecting the rig to the drill pipes when adding or removing drill pipes.

Multifunction manipulator 3 according to the present invention is particularly suitable for implementing a method of assembling drilling elements "P", e.g. for assembling and/or disassembling a stand "S" of drilling elements "P". The method of assembling according to the present invention comprises the following steps, preferably carried out in succession:

a) grasping a drilling element "P", located on a drill floor 13, by means of said lifting device 16;
b) lifting drilling element "P" along a vertical axis "Z";
c) positioning drilling element "P" in a vertical position relative to said drill floor 13;
d) moving said drilling element "P" towards a secondary well or mousehole "M";
e) inserting said drilling element "P" into said secondary well "M", holding it therein;
f) repeating steps a) to d) to handle another drilling element "P";
g) positioning drilling elements "P" in abutment with each other and fastening them together;
h) inserting the assembly of drilling elements "P" into said secondary well "M", holding it therein;
i) repeating steps f) to h) to assemble a further drilling element "P".

This sequence of steps permits creating a stand "S" of drilling elements "P" comprising at least three drilling elements "P", which are preferably all equal. In fact, it is possible to repeat the steps from f) to i) in order to connect the desired number of drilling elements "P".

By executing the above-described steps of the present method in reverse order, it will be possible to disassemble a plurality of drilling elements "P", e.g. a stand "S".

Figure 10A:
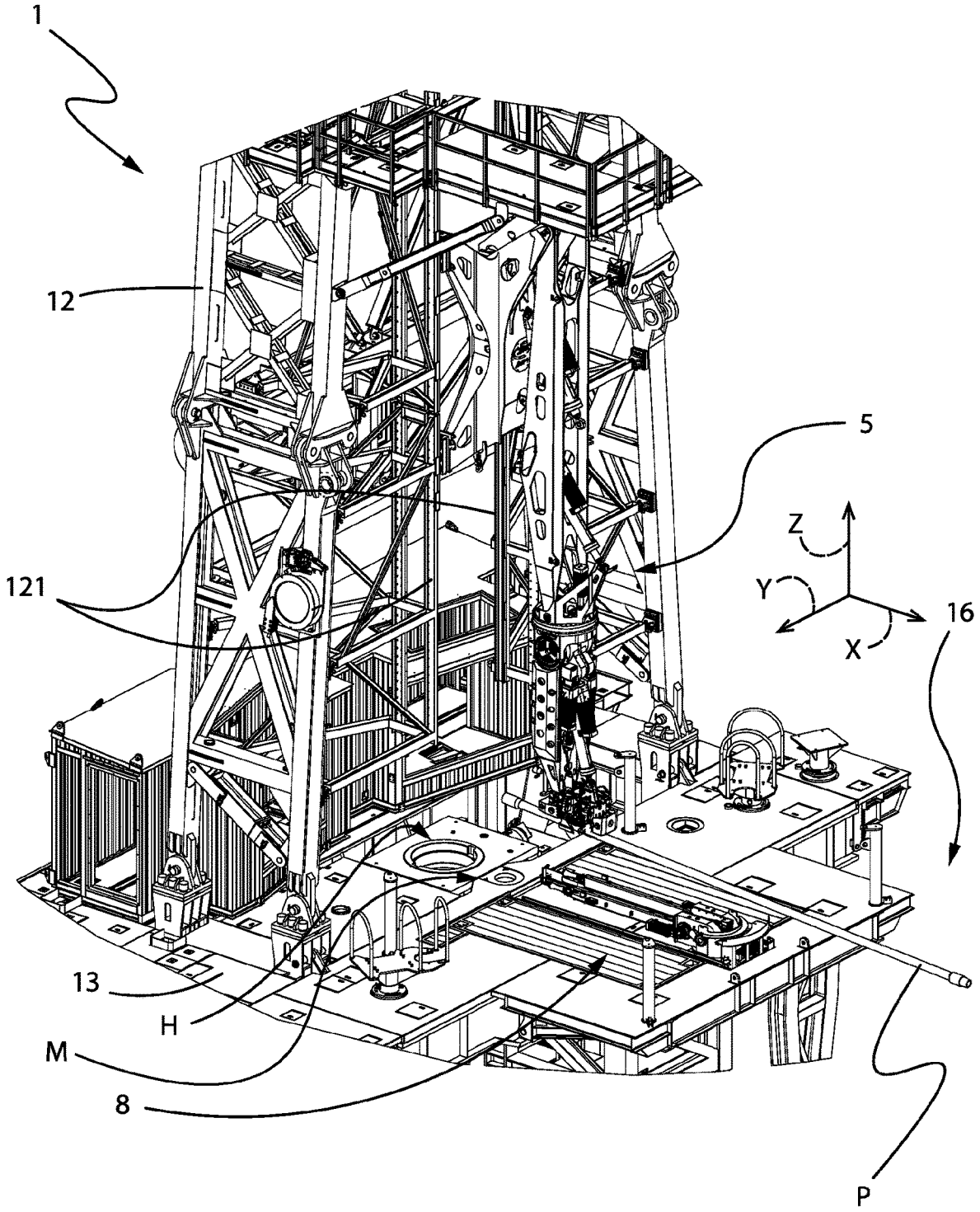
FIGS. 10A, 10B, 10C and 10D show some details of a drilling rig comprising a manipulation system, which in turn comprises a multifunction manipulator and a stabilization system, in different operating phases of the manipulation system; in particular.

The steps of the present method, according to the present invention, are carried out by means of a manipulator 3 according to the present invention. The step of grasping a drilling element "P", carried out by manipulator 3, permits grasping drilling element "P", preferably one end of drilling element "P", in a firm and safe manner. FIG. 10A shows, for example, manipulator 3 grasping one end of drilling element "P" that has been placed in proximity to drill floor 13 by a lifting device 16. This step allows drilling element "P", which has been placed on drill floor 13 and lies thereon substantially horizontal, to be automatically grasped without requiring human intervention.

The step of lifting drilling element "P" along a vertical axis "Z", carried out by means of manipulator 3 according to the present invention, allows drilling element "P" to be safely lifted while reducing the load acting upon manipulator 3 itself.

The step of positioning drilling element "P" in a vertical position by means of manipulator 3 is carried out in such a way as to reduce as much as possible the onset of sussultatory or vibratory movements of drilling element "P". This solution reduces the risk of accidents on drill floor 13. During this step, stabilization system 8 can cooperate with manipulator 3, by means of one or more arms (81, 82), in order to position drilling element "P" vertically while preventing any sussultatory or vibratory movements.

The step of moving said drilling element "P" towards a secondary well "M" envisages the use of the same manipulator 3 in order to easily, safely and quickly position drilling element "P" at the secondary well "M".

Figure 10B:
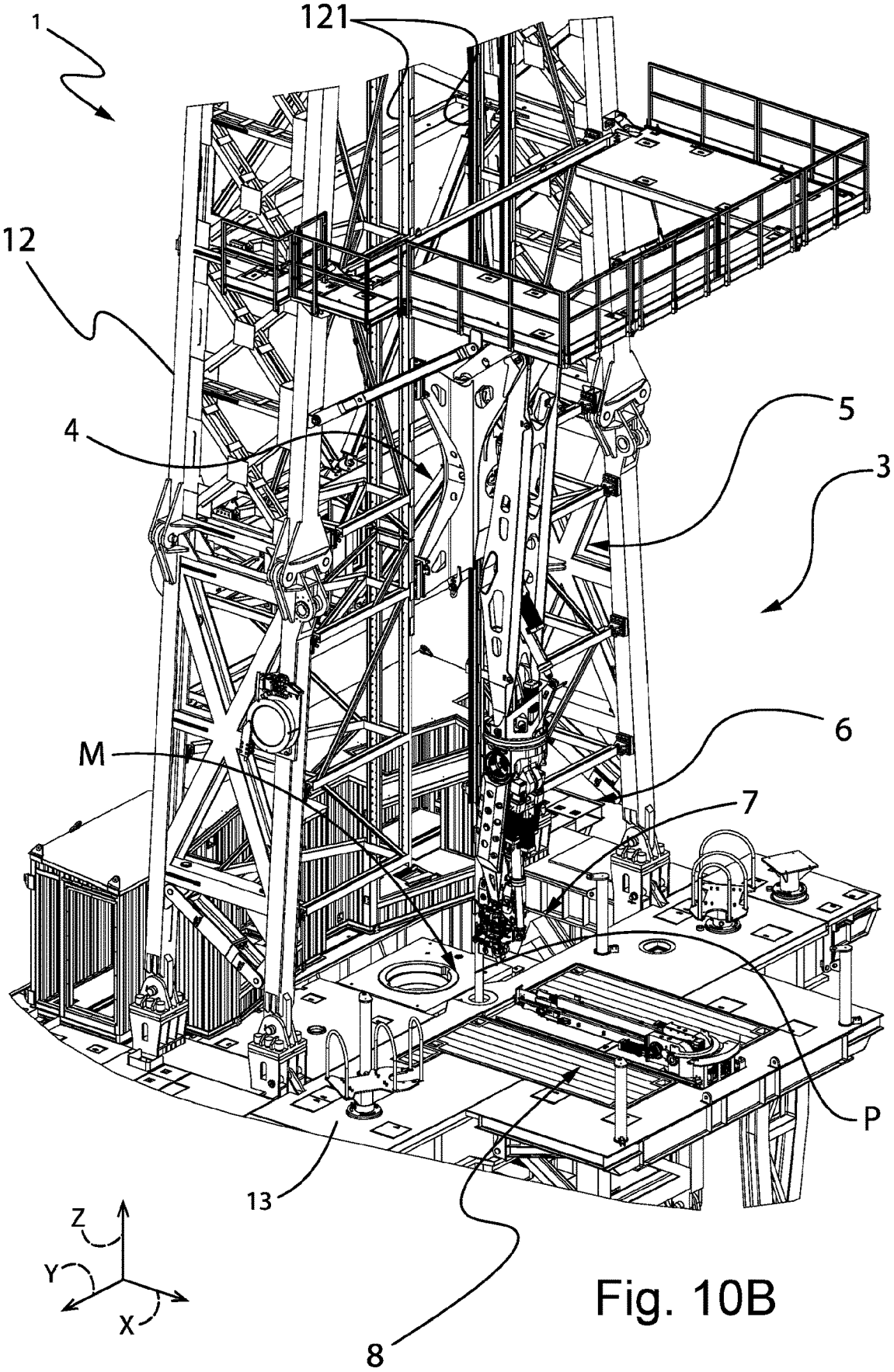

The step of inserting said drilling element "P" into said secondary well "M" while retaining it therein envisages that, once drilling element "P" has been inserted in said secondary well "M" by manipulator 3, at least one retaining device, already included in drilling rig 1, will retain drilling element "P" so that it will remain at a predefined height inside the secondary well "M". FIG. 10B shows the positioning of a first drilling element "P" inside secondary well "M" by means of said manipulator 3.

Preferably, drilling element "P" is firmly held by a clamp located inside the secondary well "M", which prevents drilling element "P" from falling into the secondary well "M".

Once the first drilling element "P" has been placed inside the secondary well "M", manipulator 3 will release drilling element "P" and will carry out the same steps already described, particularly the steps from step a) to step d) of the method according to the present invention, in order to handle another drilling element "P", in particular a second drilling element "P", preferably cooperating with said stabilization system 8.

After the second drilling element "P" has been positioned vertically in line with the secondary well "M", the step of positioning drilling elements "P" in abutment with each other and fastening them is carried out. During this step, the two drilling elements "P" are fastened to each other by means of a connection system, e.g. a power tong comprised in drill floor 13. In this manner, the torque required to ensure proper tightening is applied to the two drilling elements "P". Through said rotation system 74, manipulator 3, in particular said manipulation head 7, allows for controlled rotation of the second drilling element "P", so that it can be coupled and fastened to the first drilling element "P" inserted in the secondary well "M".

When the step of positioning drilling elements "P" in abutment with each other is complete, the step of inserting such assembled drilling elements "P" into said secondary well "M" while retaining them therein is carried out. During this step, the assembly of drilling elements "P" is inserted, by means of manipulator 3, into the secondary well "M", down to an adequate depth. When the assembly has reached the optimal depth, the assembly of drilling elements "P" is retained by the clamp located inside the secondary well "M", thus preventing the assembly of drilling elements "P" from falling into the secondary well "M". In one possible embodiment, the system that retains drilling elements "P" in the secondary well "M" is the same system that is capable of mutually fastening drilling elements "P".

Preferably, once the assembly of drilling elements "P" has been placed inside the secondary well "M", manipulator 3 will release the assembly and will carry out the same steps already described, particularly the steps from step f) to step h) of the method according to the present invention, in order to handle another drilling element "P", in particular a third drilling element "P".

The handling of the third drilling element "P" is carried out by manipulator 3 in the same way as described with reference to the first and second drilling elements "P"; the third drilling element "P" is then appropriately fastened to the assembly of the first and second drilling elements "P", inserted in the secondary well "M".

The present sequence of steps permits assembling together at least three drilling elements "P" in order to obtain a stand "S" of at least three drilling elements "P" in a simple and quick manner, with the utmost safety.

The above-described method can be repeated, in particular by repeating steps i), in order to assemble a stand "S" of drilling elements comprising more than three drilling elements "P".

More in general, the number of drilling elements "P" mutually connected to form the stand "S" will depend on the dimensions of such drilling elements "P" and on the characteristics of drilling rig 1 where such stand "S" will have to be used.

Multifunction manipulator 3 according to the present invention is particularly suitable for implementing a method of moving drilling elements "P" from a well, e.g. a secondary well or mousehole "M", to a fingerboard 14 of a drilling rig 1.

The method of moving according to the present invention comprises the following steps, preferably carried out in succession:

- grasping, by means of a manipulation head 7, a drilling element "P" which is a part of a stand "S" of drilling elements "P" retained by at least one retaining element, e.g. a clamp, at said well (M, H);
- moving said stand "S" of drilling elements "P", in particular moving said stand "S" aside from said well (M, H), towards an area where it causes less hindrance;
- reversing the orientation of said manipulation head 7, by rotating at least a part of manipulator 3 about at least one axis, preferably a vertical axis;
- moving said stand "S" towards a suitable housing 142 comprised in fingerboard 14;
- lowering said stand "S";
- releasing said drilling element "P" of stand "S" into suitable housing 142.

This sequence of steps permits moving a plurality of drilling elements "P", preferably in the form of a stand "S" of drilling elements "P", comprising, for example, three drilling elements "P", which are preferably all equal.

By executing the steps described in the present method in reverse order, it is possible to move at least one stand "S" of drilling elements "P" from the fingerboard 14 towards at least one well (H, M).

The steps of the present method, according to the present invention, are carried out by a manipulator 3 according to the present invention and by the manipulation system.

The step of grasping a drilling element "P" by means of a manipulation head 7 is preferably carried out in order to grasp a stand "S" of drilling elements "P". Depending on the well type, e.g. the main well or well center "H" or the secondary well "M", drilling element "P" comprised in stand "S" is retained by one or more mutually independent clamps. Said clamps may be either directly comprised in the well and/or associated with a device interacting with said well, such as drill head 15.

Figure 10C:
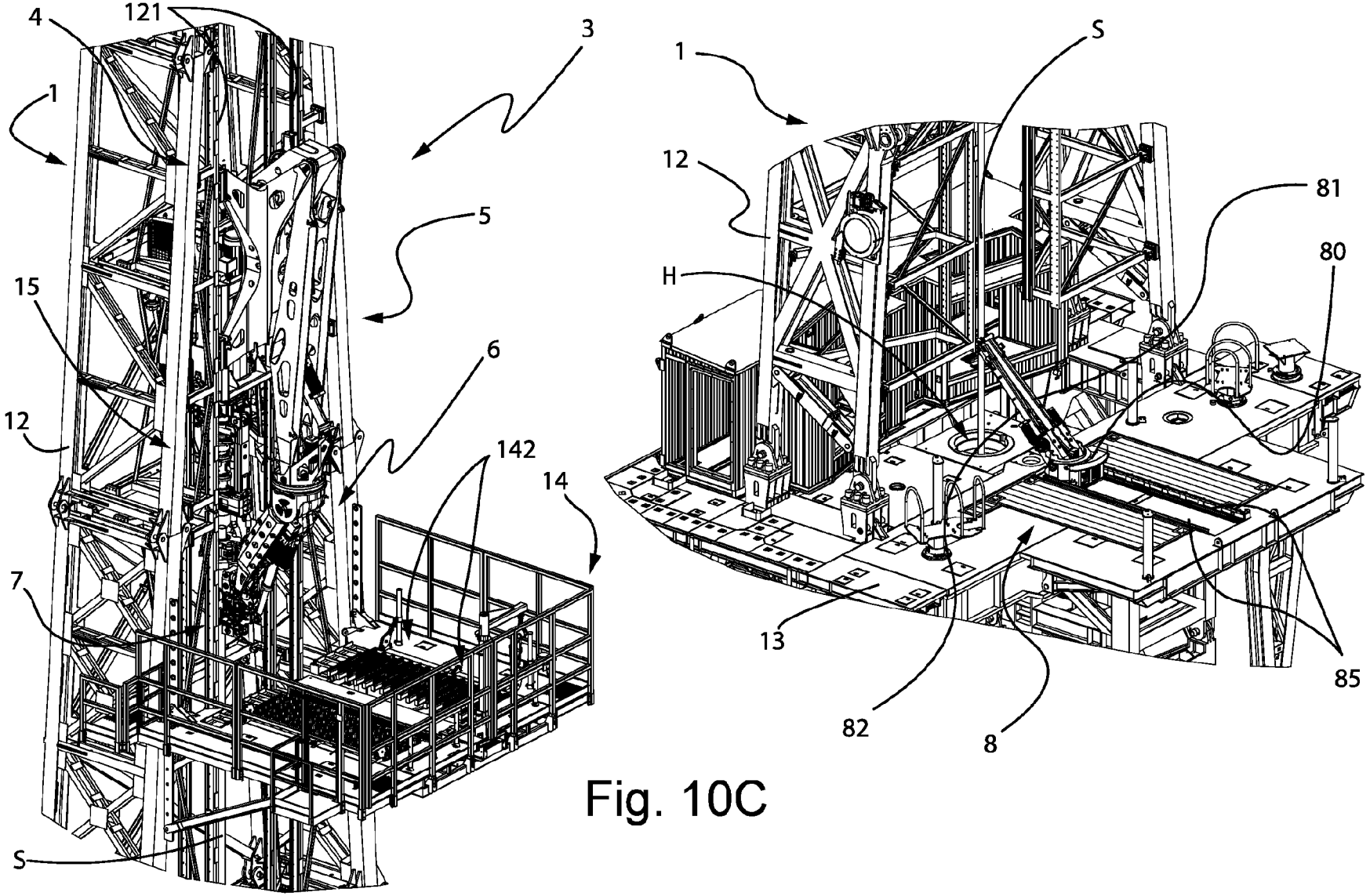

In a preferred, but non-limiting, embodiment, as shown by way of example in FIG. 10C, manipulator 3 lifts stand "S" of drilling elements "P" in such a way that one end thereof reaches a fingerboard 14 comprised in drilling rig 1. Said fingerboard 14 is located at a predefined height along mast 12, above drill floor 13. Said fingerboard 14 is designed to comprise a plurality of housings 142, preferably arranged in a rack-type fashion starting from a minimum distance from mast 12.

In general, the lifting of stand "S" by means of manipulator 3 occurs in alignment with the axis of a well (M, H), depending on the current operating phase of drilling rig 1.

In the preferred embodiment, the step of moving said stand "S" aside from said well (M, H) and towards an area where it causes less hindrance envisages to move said stand "S" along the second axis "X" by means of multifunction manipulator 3. This movement is effected in cooperation with stabilization system 8.

Preferably, said area of less hindrance is an area in front of mast 12, between mast 12 itself and the area where housings 142 of fingerboard 12 are located. Due to the characteristics of manipulator 3 according to the present invention, such area of less hindrance may be quite small.

As visible in FIG. 10C, the first end or extremity of stand "S" of drilling elements is grasped by stabilization system 8, being retained between the two arms (81, 82) of said stabilization system 8, e.g. between the two rollers 83.

Subsequently, the method envisages a step of reversing the orientation of said manipulation head 7 by rotating at least a part of manipulator 3.

In the preferred embodiment, said part of manipulator 3 is turned about an axis parallel to said vertical axis "Z". In this way, manipulator 3 can place a stand "S" into the optimal position for inserting it into fingerboard 14, even when the room available for this manoeuvre is limited. Preferably, as manipulator 3 rotates, also stabilization system 8, which is preferably in line with said manipulator 3, rotates about the same axis. In an exemplary, but non-limiting, embodiment, the reversal of the orientation of manipulation head 7 of manipulator 3 is such as to put manipulator 3 in the best configuration that allows an easy positioning of drilling element "P" inside fingerboard 14. This step allows manipulator 3 to be immediately used for other manipulations of drilling elements "P", as required by drilling rig 1.

Subsequently, the method envisages a step of moving said drilling element "P" towards a suitable housing 142 comprised in fingerboard 14. During this step, it is necessary to move manipulator 3 to reach the corresponding suitable housing 142, comprised in fingerboard 14. During this step, it is possible to change the distance from mast 12 along said second axis "X" by means of said articulated arm 5, as well as to turn about an axis parallel to said axis "Z", and/or to adapt the position of manipulation head 7 by means of said robotic apparatus 6. In particular, it is possible to suitably activate one or more electric actuators (62A, 62B, 62C) comprised in robotic apparatus 6 to reach any housing 142 of fingerboard 14, said housings 142 lying in a horizontal plane defined by the second axis "X" and third axis "Y".

Preferably, said stabilization system 8 cooperates in moving stand "S" by following in a coordinated manner the movements made by manipulator 3.

Figure 10D:
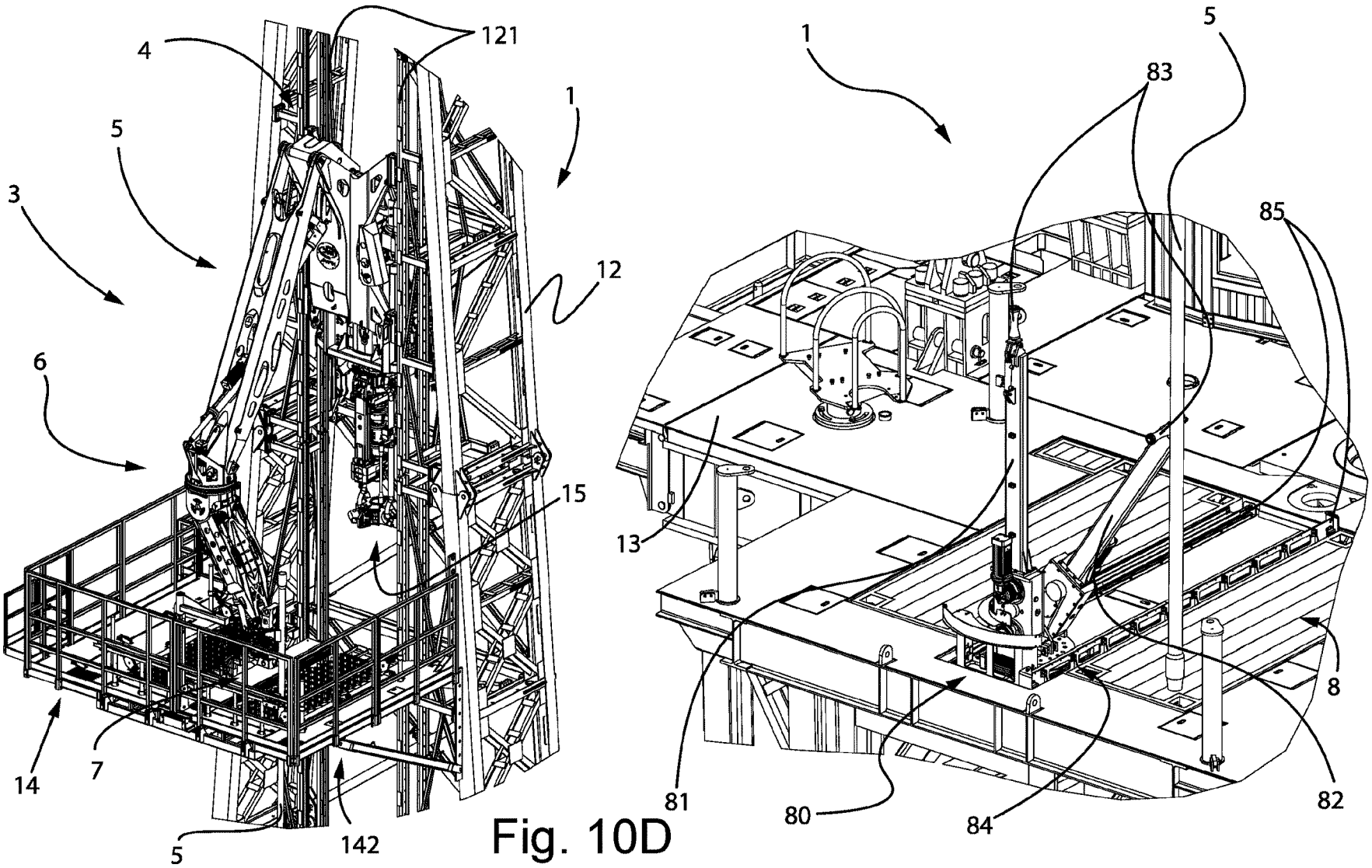

In the exemplary, but non-limiting, embodiment shown in FIG. 10D, stand "S" of drilling elements "P" is moved, by said manipulator 3 and stabilization system 8, to a suitable housing 142 comprised in fingerboard 14.

In this figure one can see that said manipulation system can reach any housing 142 of fingerboard 14 in a simple and quick manner. Moreover, the same figure shows how stabilization system 8 cooperates with manipulator 3, thus creating a manipulation system capable of guiding stand "S" of drilling elements "P". The figure shows an arm, in particular the second arm 82, aiding in pushing stand "S" into the suitable housing 142, in cooperation with manipulator 3.

Subsequently, the method envisages a step of lowering said stand "S". During this step it is possible to, by means of manipulator 3, place the drilling element "P", and in particular the stand "S", into the appropriate position inside housing 142, so that it can be suitably grouped and/or stored for further use by a drilling rig 1.

The method according to the present invention then envisages a step of releasing said drilling element "P" of stand "S" into the suitable housing 142. Preferably, stand "S" of drilling elements "P", once it has been properly placed into housing 142, is released by manipulator 3, which can then be used to perform other tasks in drilling rig 1. Likewise, stabilization system 8 is moved for reuse or to be stored in an area and/or configuration causing less hindrance.

Drilling element "P" placed in housing 142 of fingerboard 14 can be subsequently retrieved, e.g. by the same manipulator 3 or by the manipulation system, to be used in the drilling procedure being executed by drilling rig 1 and/or for disassembling it into a plurality of drilling elements "P".

Furthermore, multifunction manipulator 3 and/or the manipulation system according to the present invention are particularly suitable for implementing a method of moving drilling elements "P" from a fingerboard 14 towards a well (M, H), preferably a main well or well center "H", of a drilling rig 1. The method of moving drilling elements "P" from a fingerboard 14 towards a well (M, H) according to the present invention comprises the following steps, preferably carried out in succession:

i. grasping, by means of a manipulation head 7, a drilling element "P" comprised in a stand "S" located in a suitable housing 142 comprised in fingerboard 14;
ii. lifting said stand "S" of drilling elements "P";
iii. moving said stand "S" towards an area where it causes less hindrance to the rest of drilling rig 1;
iv. reversing the orientation of said manipulation head 7, by rotating at least a part of manipulator 3 about at least one axis;
v. moving said stand "S" into alignment with said well (M, H);
vi. releasing stand "S" of drilling elements "P", which is retained by at least one retaining element, e.g. a clamp, in said well (M, H).

This sequence of steps permits moving a plurality of drilling elements "P" in the form of a stand "S" comprising, for example, three drilling elements "P", which are preferably all equal.

By executing the steps described in the present method in reverse order, it is possible to move at least one stand "S" from at least one well (H, M) towards fingerboard 14.

The steps of the present method, according to the present invention, are carried out by a manipulator 3 or by the manipulation system according to the present invention.

The step of grasping, by means of a manipulation head 7, is executed by manipulator 3, which, thanks to its degrees of freedom, can reach any stand "S" housed in any housing 142 of fingerboard 14, being able to grasp it by means of said manipulation head 7.

Subsequently, a step of lifting said stand "S" is carried out. Said manipulator 3 can, after having grasped drilling element "P", lift stand "S", e.g. by making a movement along said axis "Z".

Subsequently, the method envisages a step of moving said stand "S" towards an area where it causes less hindrance to the rest of drilling rig 1. Preferably, said area of less hindrance is an area in front of mast 12, between mast 12 and the area where housings 142 of fingerboard 14 are located.

In the preferred embodiment, stand "S" of drilling elements "P" is placed in an area of less hindrance by said manipulator 3, in cooperation with said stabilization system 8. Thus, manipulator 3 moves stand "S" of drilling elements "P" from housing 142 towards an area where further handling can occur.

Subsequently, the method envisages a step of reversing the orientation of said manipulation head 7 by turning at least a part of manipulator 3 about an axis, preferably a vertical axis. It is thus possible, while taking up little room, to put manipulator 3 in the best conditions for positioning the same stand "S" of drilling elements "P" ready for the next handling operations.

In this exemplary, but non-limiting, embodiment, the reversal of the orientation of manipulation head 7 of manipulator 3 is such as to set manipulator 3 in the best configuration for easily moving stand "S" towards the well (H, M). This movement is coordinated with said stabilization system 8.

For the purposes of the present description, the reversal of the orientation of said manipulation head 7, effected by turning at least a part of manipulator 3 during the execution of any method of moving according to the present invention, can be carried out by means of a movement of more than one part of manipulator 3, even about more than one axis, depending on the conformation of said manipulator 3, e.g. through a combination of movements about horizontal axes. Moreover, the movements are coordinated with said stabilization system 8.

In general, the method envisages that the above steps are followed by a step of moving said stand "S" into alignment with said well (M, H).

The handling of stand "S" of drilling elements "P" effected by said manipulator 3 in order to set it inline with the axis of the well, preferably positioning it at well center "H", makes it possible to position stand "S" in line with the well where such stand "S" of drilling elements "P" is required.

Said stabilization system 8 cooperates with manipulator 3 in correctly positioning said stand "S" in line with said well.

Subsequently, the method envisages a step of releasing drilling element "P". During this step, manipulator 3 releases drilling element "P", since stand "S" is already retained by at least one clamp. Thus, stand "S" is delivered by manipulator 3, and more generally by the manipulation system, to another device comprised in drilling rig 1, e.g. drill head 15, permitting the use of manipulator 3 for other tasks in drilling rig 1.

In an exemplary, but non-limiting, embodiment, manipulator 3 can be used, after having released stand "S" of drilling elements "P", which is supported by a clamp comprised in drill head 15, for performing other tasks, thus automating the operation of drilling rig 1 according to the present invention.

Control unit 32 of manipulator 3, and more generally control unit 10 of the manipulation system and/or of drilling rig 1, are adapted to control the execution of at least a part of the methods according to the present invention, e.g. in cooperation with each other, e.g. by coordinating the movements of manipulator 3 and of stabilization system 8 comprised in the manipulation system according to the present invention.

Figure 1A:
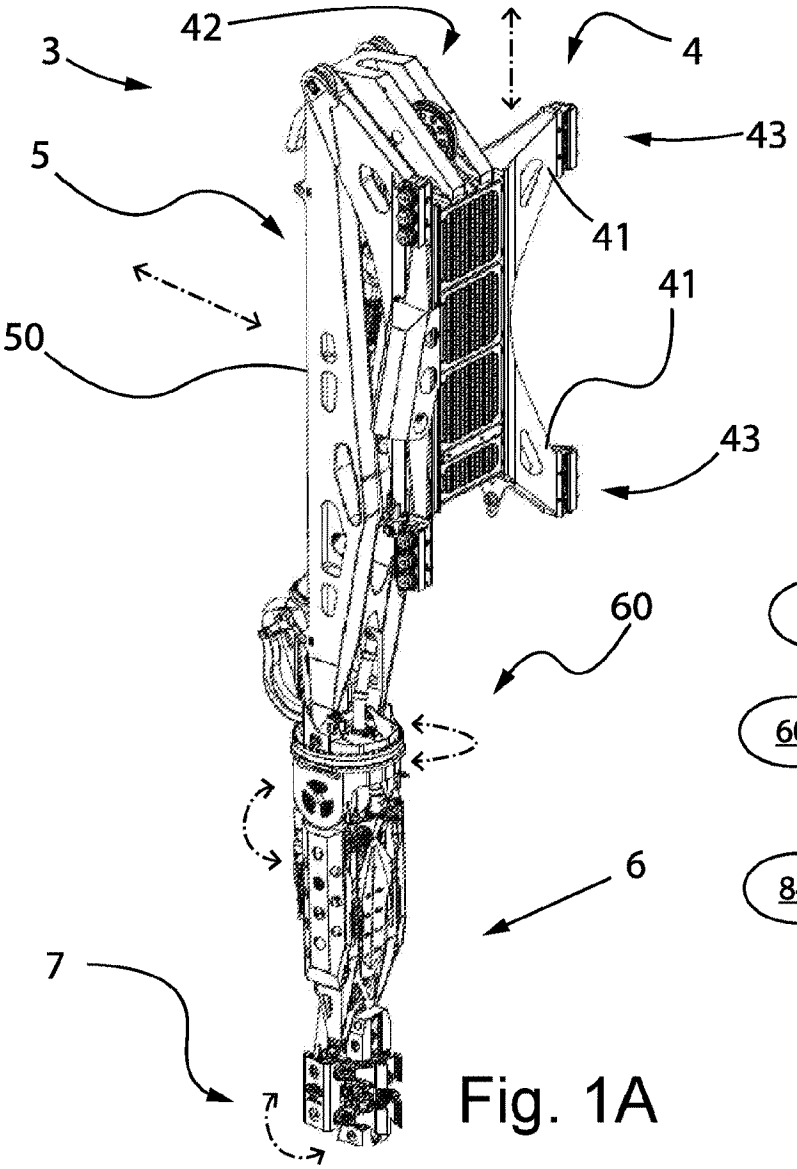

FIG. 1A shows a perspective rear view of one possible embodiment of manipulator 3 according to the present invention in one possible operating configuration. In this figure one can see carriage 4 comprising sliding blocks 41 for sliding along guides 121 provided on mast 12, part of hoisting system 42, in particular the pulley, and emergency braking system 43 arranged on sliding blocks 41. In this figure one can also see articulated arm 5, comprising a monolithic body 50, suitably connected to carriage 4. The figure also shows robotic apparatus 6, suitably connected to articulated arm 5. Slewing ring 60 is also visible, mounted to the first end of robotic apparatus 6. To the opposite end of robotic apparatus 6 manipulation head 7 is appropriately connected. The figure also shows some of the possible movements of the various parts of manipulator 3 according to the present invention.

FIG. 1B schematically shows how control system 32 of manipulator 3 is electrically and/or electronically connected to the motors and/or actuators (42, 51, 52, 62A, 62B, 62C, 73) and/or sensors (33) and/or safety systems (43, 75) comprised in said manipulator 3 in order to optimally control the latter. Said control system 32 is electronically connected to control unit 10 that controls the manipulation system and, more in general, the whole drilling rig 1. Said control unit 10 can coordinate manipulator 3 and stabilization system 8 of the manipulation system, in particular by controlling the operation of actuators 84 of stabilization system 8. In addition, said control unit 10 controls the automation of drill head 15, of lifting device 16, and of other systems included in drilling rig 1.

Figure 2A:
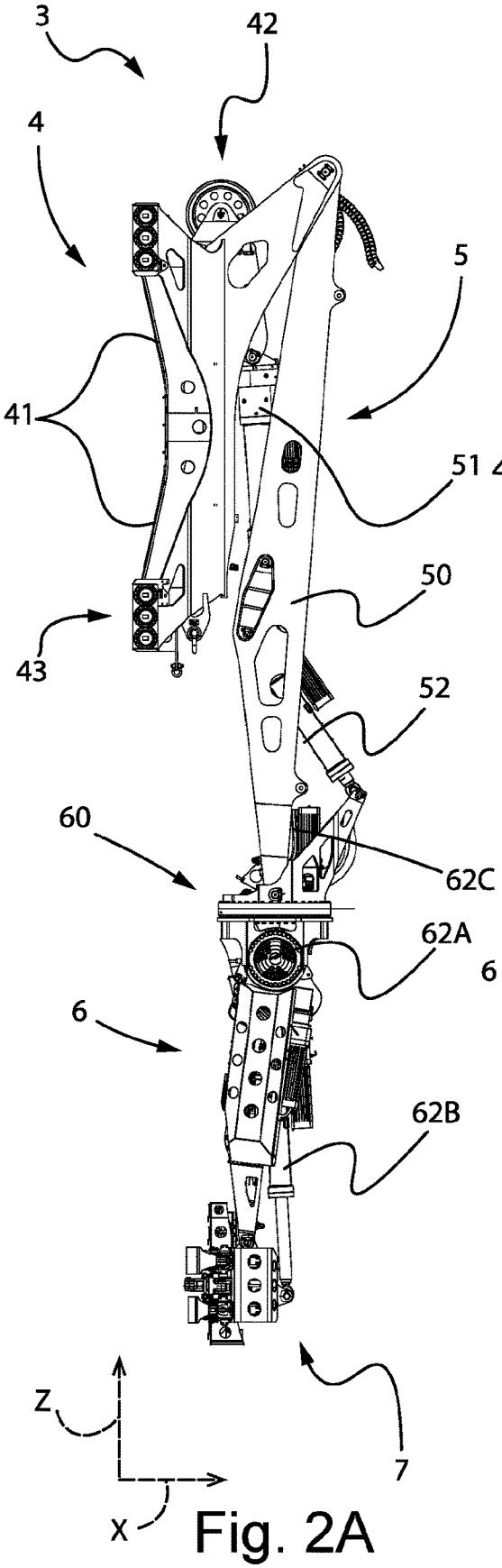
FIGS. 2A and 2B show the manipulator of FIG. 1 in a first operating configuration; in particular.

Describing now more in detail the construction of the preferred embodiment of manipulator 3, FIG. 2A shows a side view of the manipulator in a first operating configuration.

In such first operating configuration, articulated arm 5 is operated by means of the actuator (51, 52) in order to place the first end of robotic apparatus 6 in proximity to carriage 4, with reference to said second axis "X". In the first operating configuration, manipulator 3 can grasp and/or hold, by means of said manipulation head 7, a drilling element "P", e.g. comprised in a stand "S", for moving it, grasping it, or placing it into a secondary well "M".

In this figure one can see the various actuators included in manipulator 3, in particular for moving articulated arm 5, robotic apparatus 6 and manipulation head 7.

Figure 2B:
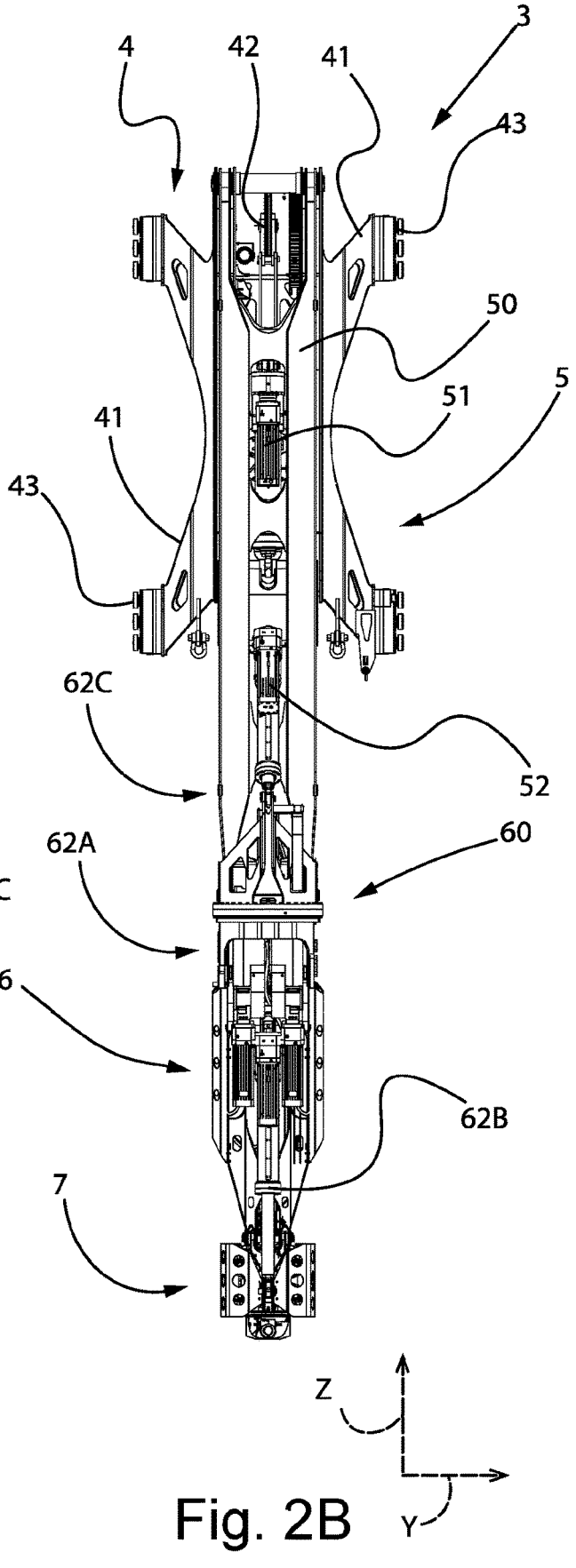

FIG. 2B shows a front view of manipulator 3 in the first operating configuration. In this figure one can see that manipulator 3 is aligned with a vertical axis. The figure shows, from another viewpoint, the various actuators included in manipulator 3, in particular for moving articulated arm 5, robotic apparatus 6 and manipulation head 7.

Figure 3A:
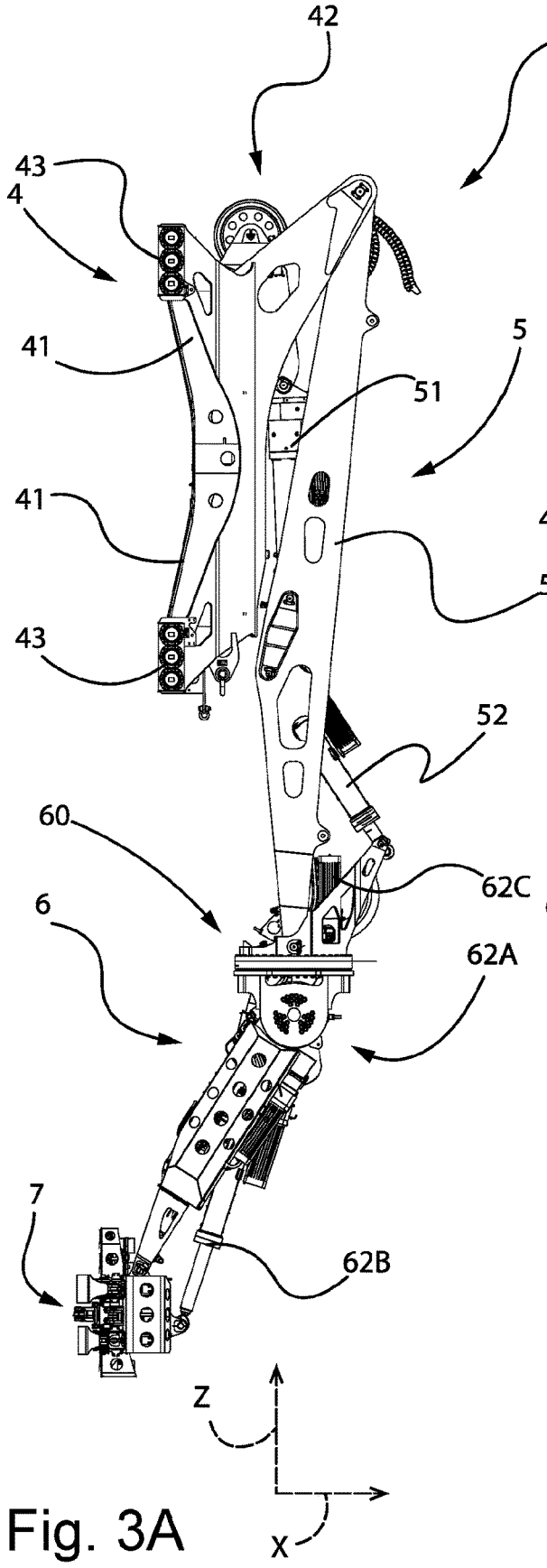
FIGS. 3A and 3B show the manipulator of FIG. 1 in a second operating configuration; in particular.

FIG. 3A shows a side view of the manipulator in a second operating configuration, in particular of robotic apparatus 6. In such second operating configuration, articulated arm 5 is operated by means of the actuators (51, 52) in order to place the first end of robotic apparatus 6 in proximity to carriage 4. Also, the first electric actuator 62A of robotic apparatus 6 is activated in order to move manipulation head 7 aside from carriage 4. In the second operating configuration, manipulator 3 can grasp and/or hold, by means of said manipulation head 7, a drilling element "P", e.g. comprised in a stand "S", for moving it, grasping it, or placing it into a well center "H". Such configuration permits moving drilling elements to well center "H" without hindering the movements of a drill head 15. In this figure one can see the various actuators included in manipulator 3, in particular for moving articulated arm 5, robotic apparatus 6 and manipulation head 7. By comparing this figure with FIG. 2A, one can identify those actuators which have been activated in order to achieve such second configuration.

Figure 3B:
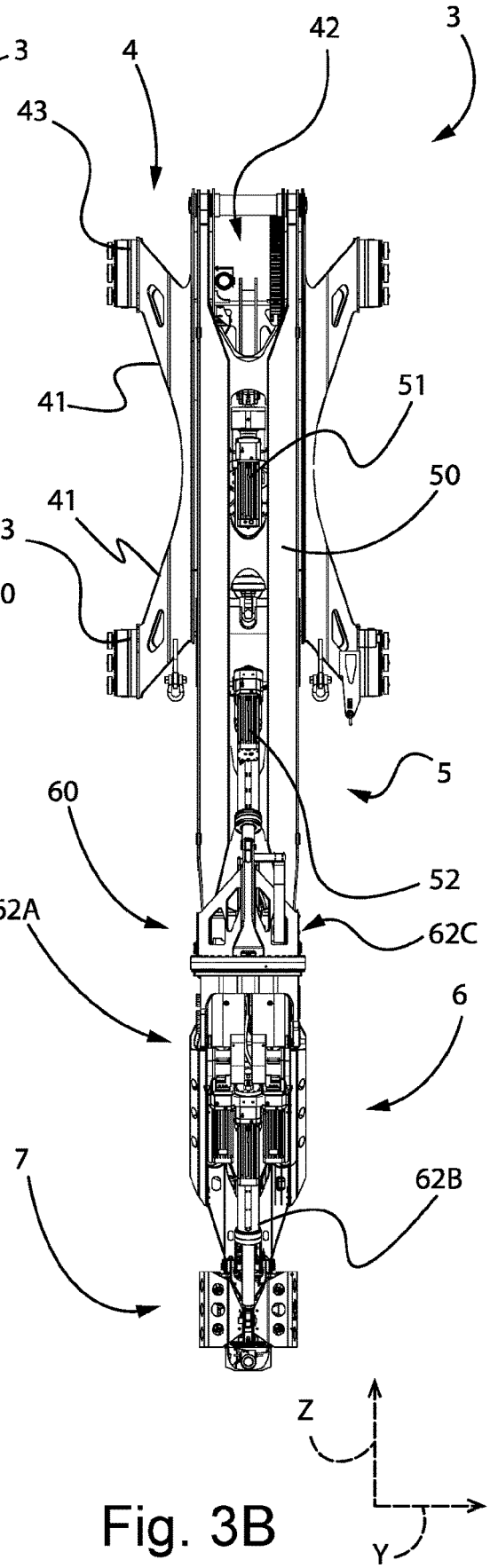

FIG. 3B shows a front view of manipulator 3 in the second operating configuration, in particular of robotic apparatus 6. In this figure one can see that manipulator 3 is aligned with a vertical axis. The figure shows, from another viewpoint, the various actuators included in manipulator 3, in particular for moving articulated arm 5, robotic apparatus 6 and manipulation head 7.

Figure 4B:
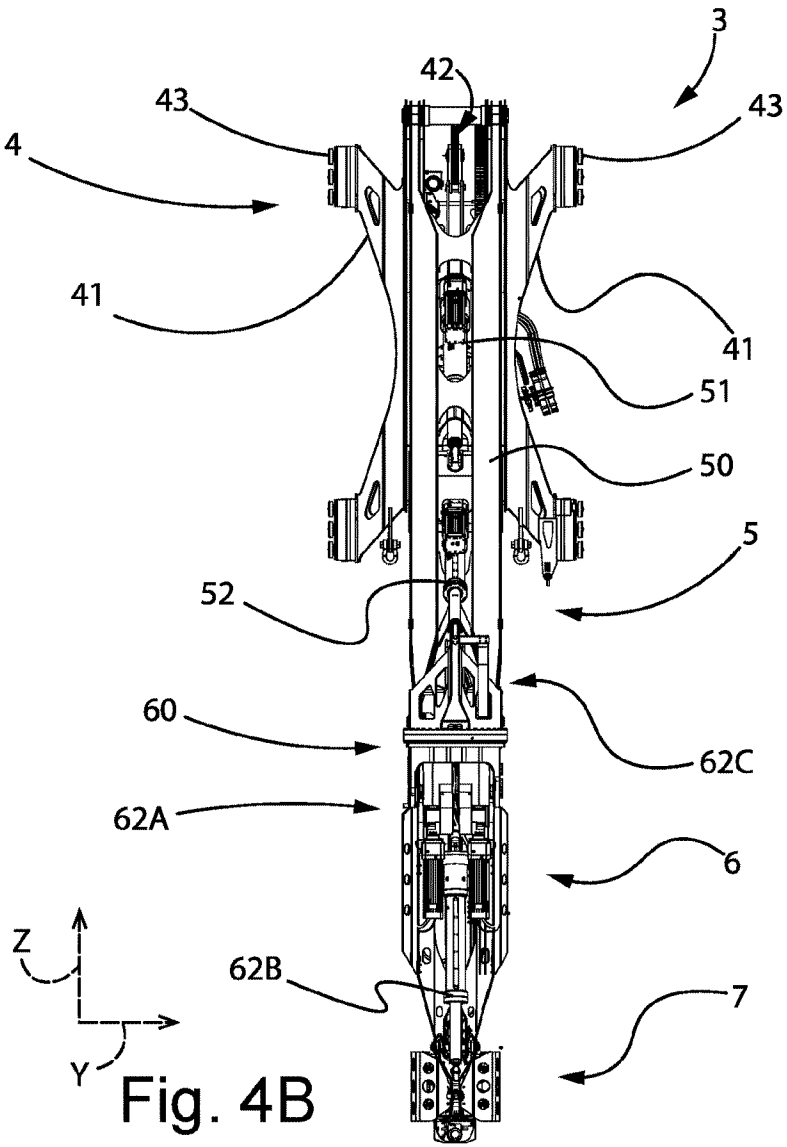
FIGS. 4A and 4B show the manipulator of FIG. 1 in a third operating configuration; in particular.
Figure 4A:
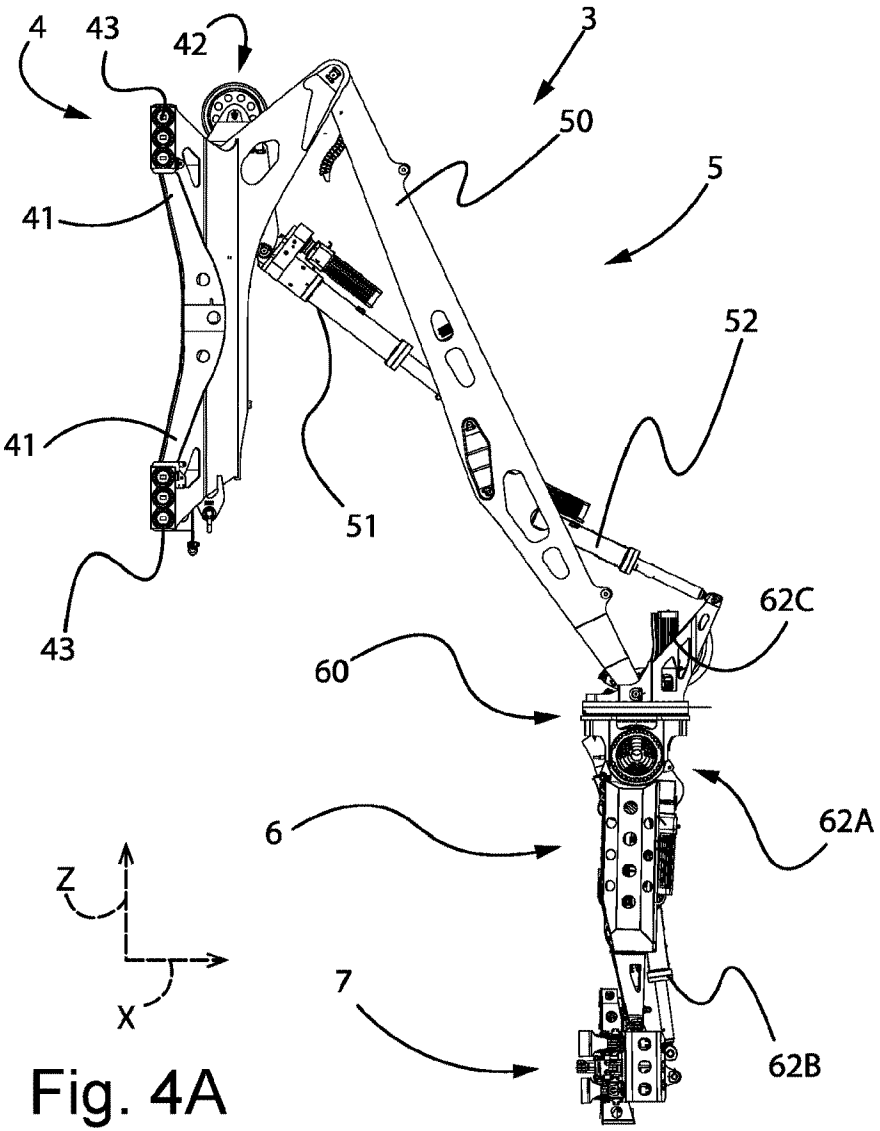

FIG. 4A shows a side view of the manipulator in a third operating configuration, wherein articulated arm 5 has assumed an extended configuration, in comparison with the operating configuration illustrated in FIGS. 2A-2B. In such third operating configuration, articulated arm 5 is operated by means of the actuators (51, 52) in order to move the first end of robotic apparatus 6 away from carriage 4. In the third operating configuration, manipulator 3 can hold, by means of said manipulation head 7, a drilling element "P", e.g. comprised in a stand "S", for moving it from a well (H, M) to a fingerboard, and vice versa.

In this figure one can see the various actuators included in manipulator 3, in particular for moving articulated arm 5, robotic apparatus 6 and manipulation head 7. By comparing this figure with FIG. 2A or 3A, it is possible to identify those actuators which have been activated in order to achieve such third configuration.

FIG. 4B shows a front view of manipulator 3 in the third operating configuration, wherein articulated arm 5 has assumed an extended configuration. In this figure one can see that manipulator 3 is aligned with a vertical axis. The figure shows, from another viewpoint, the various actuators included in manipulator 3, in particular for moving articulated arm 5, robotic apparatus 6 and manipulation head 7.

Figures 5A, 5B, 5C:
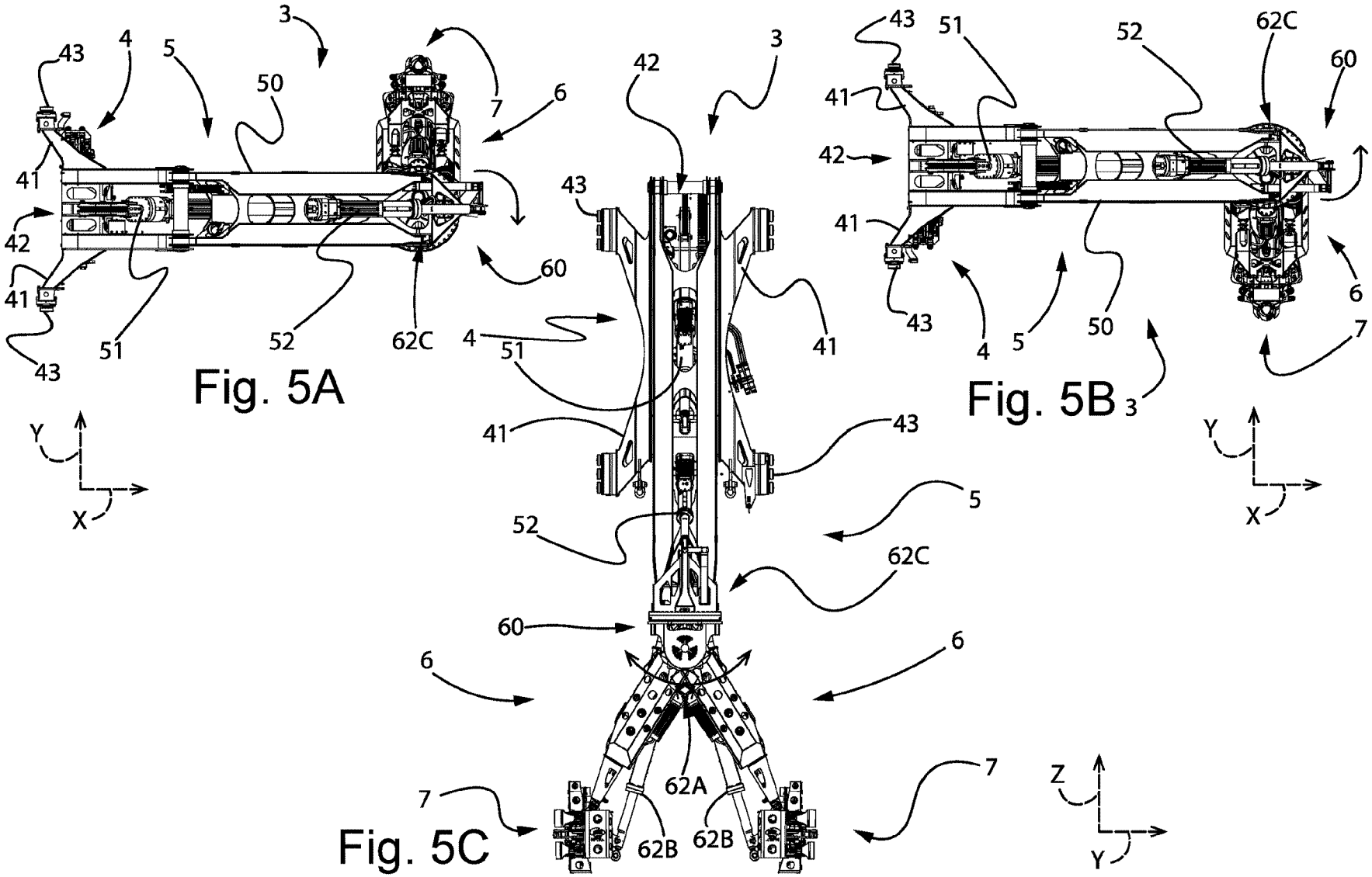
FIGS. 5A, 5B, 5C show the manipulator of FIG. 1 in different operating configurations; in particular.

FIG. 5A shows a top view of the manipulator in a fourth operating configuration, in particular of manipulation head 7, achieved through robotic apparatus 6 and articulated arm 5. In such fourth operating configuration, articulated arm 5 is operated by means of the actuators (51, 52) in order to move the first end of robotic apparatus 6 away from carriage 4. In the same operating configuration, slewing ring 60 is activated in order to rotate robotic apparatus 6 and manipulation head 7, positioning itself perpendicular to the second axis "X" along which articulated arm 5 extends, e.g. parallel to said third axis "Y". In the fourth operating configuration, manipulator 3 can hold, by means of said manipulation head 7, at least one drilling element "P", e.g. comprised in a stand "S", for positioning said stand "S" into a housing 142 of fingerboard 14 or for picking up said stand "S" from said housing 142.

FIG. 5B shows a top view of the manipulator in a fifth operating configuration, wherein manipulation head 7 has been rotated about an axis parallel to the vertical axis, compared with the operating configuration illustrated in FIG. 5A. The fifth operating configuration is substantially similar to the fourth operating configuration as concerns the positioning of articulated arm 5; however, there is a change in the position of robotic apparatus 6 and of the manipulation head, which, compared with the fourth operating configuration, is turned by 180° about the axis of slewing ring 60. The functionality of such fifth operating configuration is substantially similar to that of the fourth operating configuration.

Lastly, FIG. 5C shows a front view of the manipulator 3, wherein the fourth operating configuration and the fifth operating configuration are overlaid, so that they can be compared. As can be understood from the overlay drawing, articulated arm 5 remains essentially unchanged, whereas robotic apparatus 6 and manipulation head 7 are rotated by 180° about the vertical axis of slewing ring 60. In this figure one can see that only the third electric actuator 62C has been operated in order to rotate slewing ring 60, while the other actuators, i.e. those of articulated arm 5 and the remaining ones of robotic apparatus 6, have remained unchanged.

Figure 6B:
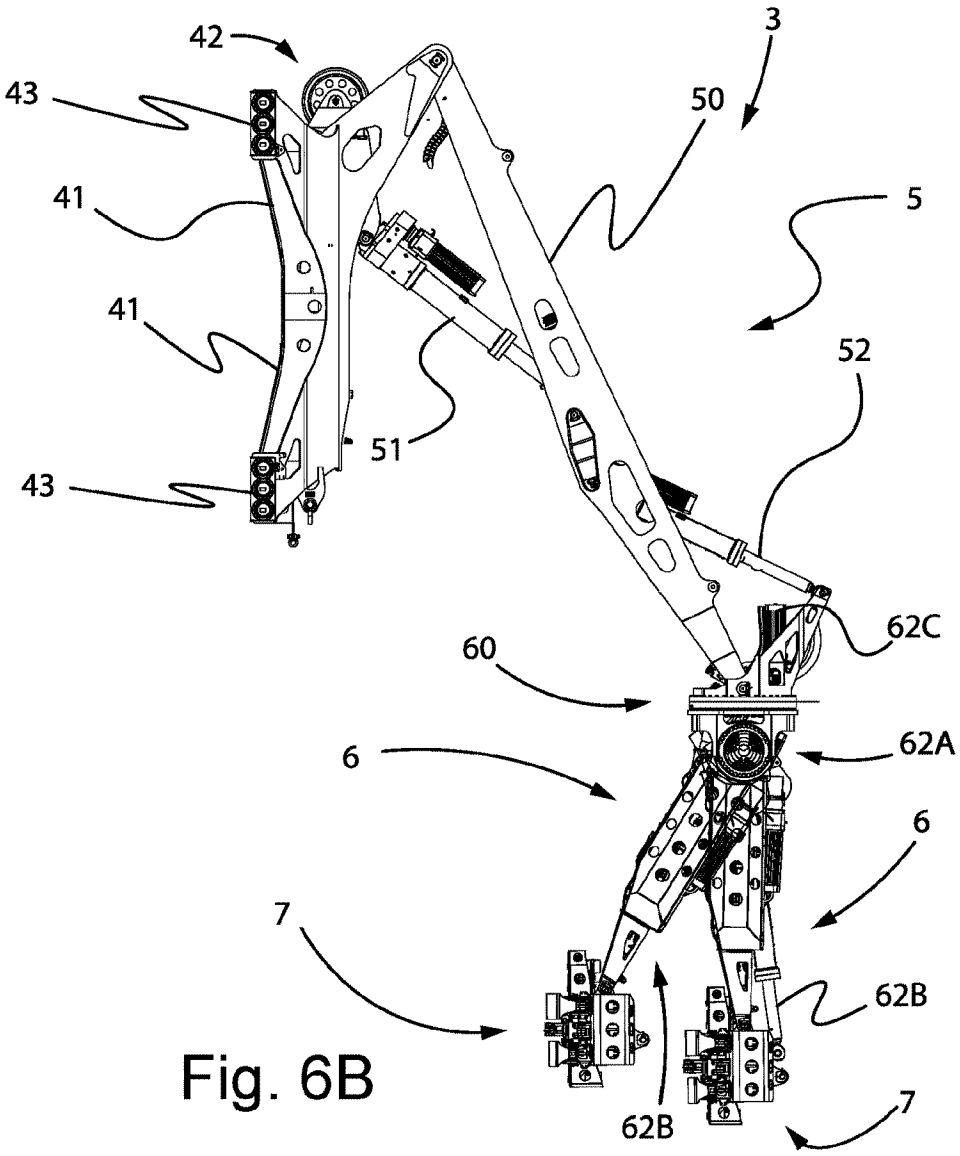
FIGS. 6A and 6B show the manipulator of FIG. 1 in different operating configurations; in particular.
Figure 6A:
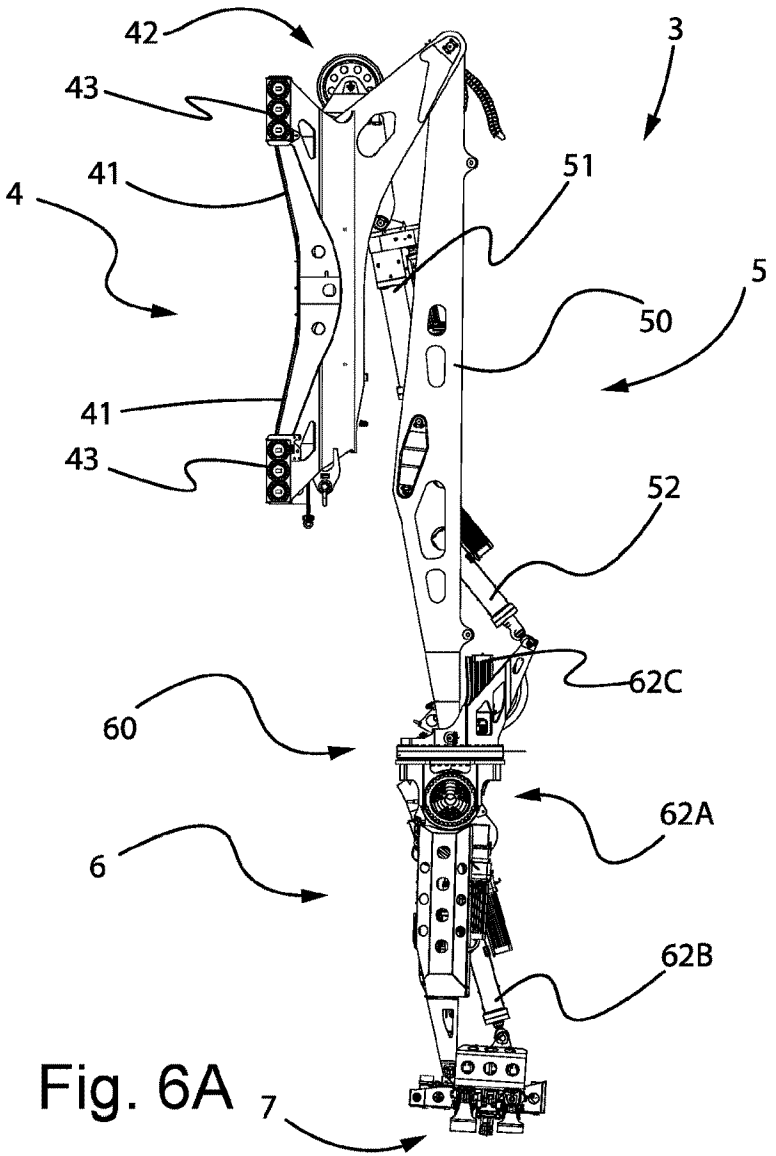

FIG. 6A shows a side view of manipulator 3 in a sixth operating configuration, in particular of manipulation head 7. In such sixth operating configuration, articulated arm 5 is operated by means of the actuators (51, 52) in order to place the first end of robotic apparatus 6 in proximity to carriage 4. A comparison with the first operating configuration, e.g. illustrated in FIG. 2A, shows that the second electric actuator 62B has been activated in order to rotate manipulation head 7 about a horizontal axis. The other parts of manipulator 3 have remained essentially unchanged in comparison with the first operating configuration.

In the sixth operating configuration, manipulator 3 can grasp and/or hold, by means of said manipulation head 7, a drilling element "P" that has been placed on the drill floor by a lifting device or catwalk 16, such drilling element "P" being substantially horizontal. In such sixth configuration it is possible to lift drilling element "P" and set it in a vertical position, so that it can be inserted into a well (H, M), and vice versa.

In this figure one can see the various actuators included in manipulator 3, in particular for moving articulated arm 5, robotic apparatus 6 and manipulation head 7.

FIG. 6B shows a side view of manipulator 3, wherein a seventh operating configuration and the third operating configuration are overlaid so that they can be compared, in particular wherein articulated arm 5 has assumed an extended configuration. The overlay drawing shows that, by means of the first electric actuator 62A, it is possible to bring manipulation head 7 closer to carriage 4 without activating the actuators (51, 52) of articulated arm 5. Moreover, as can be understood by comparing the two operating configurations, through the second electric actuator 62B it is possible to maintain the verticality of manipulation head 7, and in particular of the two clamps comprised therein. In the third operating configuration, as well as in the seventh operating configuration, manipulator 3 can hold, by means of said manipulation head 7, a drilling element "P", e.g. comprised in a stand "S", for moving it from a well (H, M) to a fingerboard 14, and vice versa.

FIGS. 1A, 2A-6B illustrate, by way of non-limiting example, one possible embodiment of carriage 4, of sliding blocks 41, of hoisting system 42, in particular the pulley, and of emergency braking system 43. From such figures, a person skilled in the art can understand the construction details of carriage 4.

Figure 7A:
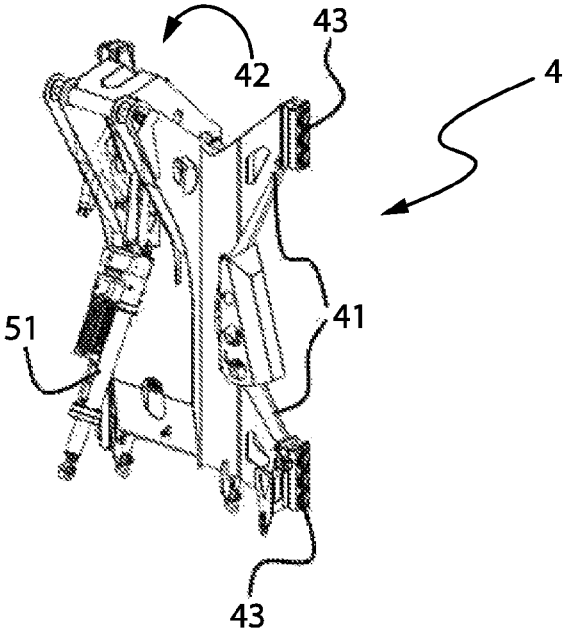
FIGS. 7A, 7B, 7C show some details of a preferred embodiment of the carriage; in particular.
Figure 7C:
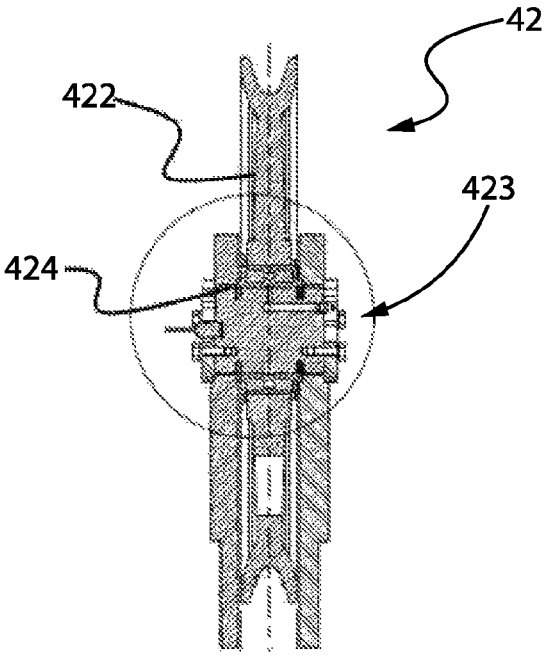
Figure 7B:
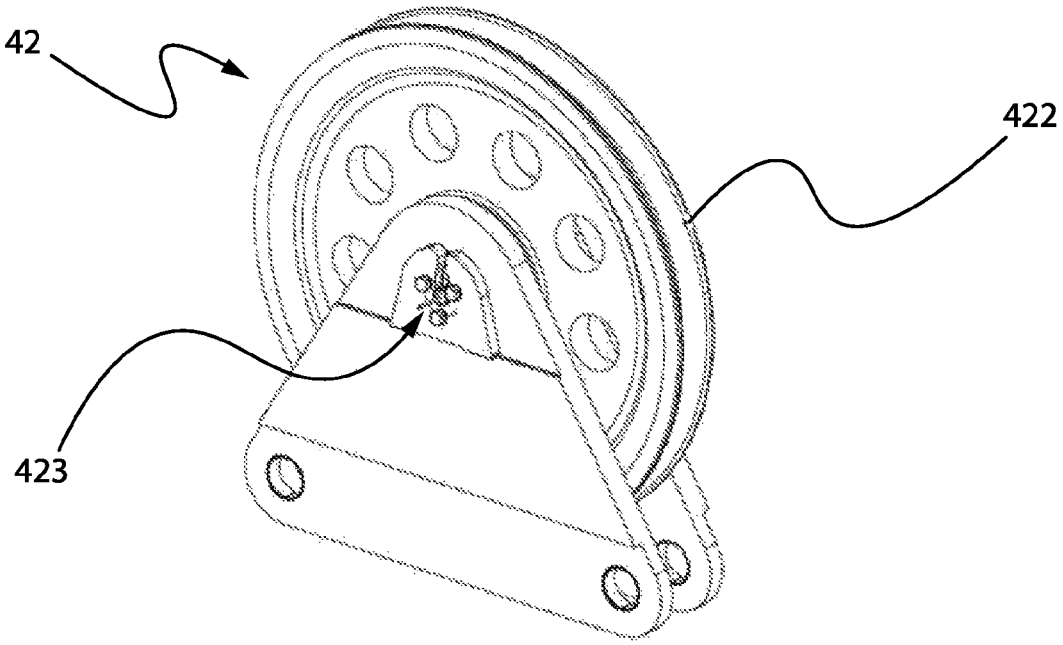

FIGS. 7A, 7B, 7C show further details of a preferred embodiment of carriage 4.

FIG. 7A shows an axonometric front view of carriage 4 alone. The first actuator 51 of articulated arm 5 is connected to carriage 4 of manipulator 3 shown in the drawing, in particular one end thereof being connected to the structure of carriage 4. The figure shows the housing in which part of hoisting system 42 can be accommodated. In this figure one can see the position of emergency braking system 43 at the extremities of sliding block 41 of carriage 4. The structural conformation is clearly visible in FIG. 7A, and the construction details can be inferred by a person skilled in the art without needing any further explanation.

FIG. 7B shows an axonometric view of pulley 422 comprised in hoisting system 42 of the carriage.

On such pulley 422 the rope runs, driven by winch 420. Such pulley 422 is adapted to rotate about the axis of pin 423. Said pulley is suitably fixed to the structure of carriage 4, e.g. in the location indicated in FIG. 7A.

FIG. 7C shows a sectional view of pulley 422 of FIG. 7B. In this figure one can see that one or more force sensors, in particular load cells 424, are associated with pin 423, for the purpose of determining the action being exerted on carriage 4, as previously specified. As previously specified, depending on the force detected by load cell 424, control system 32 of manipulator 3 can determine whether a drilling element "P", and which one, e.g. the first one, the second one or the third one, is being supported or not by the manipulator, based on the weight thereof.

The construction details of pulley 422, pin 423 and load cell 424 can be understood by a person skilled in the art without needing any further explanation.

Figure 8B:
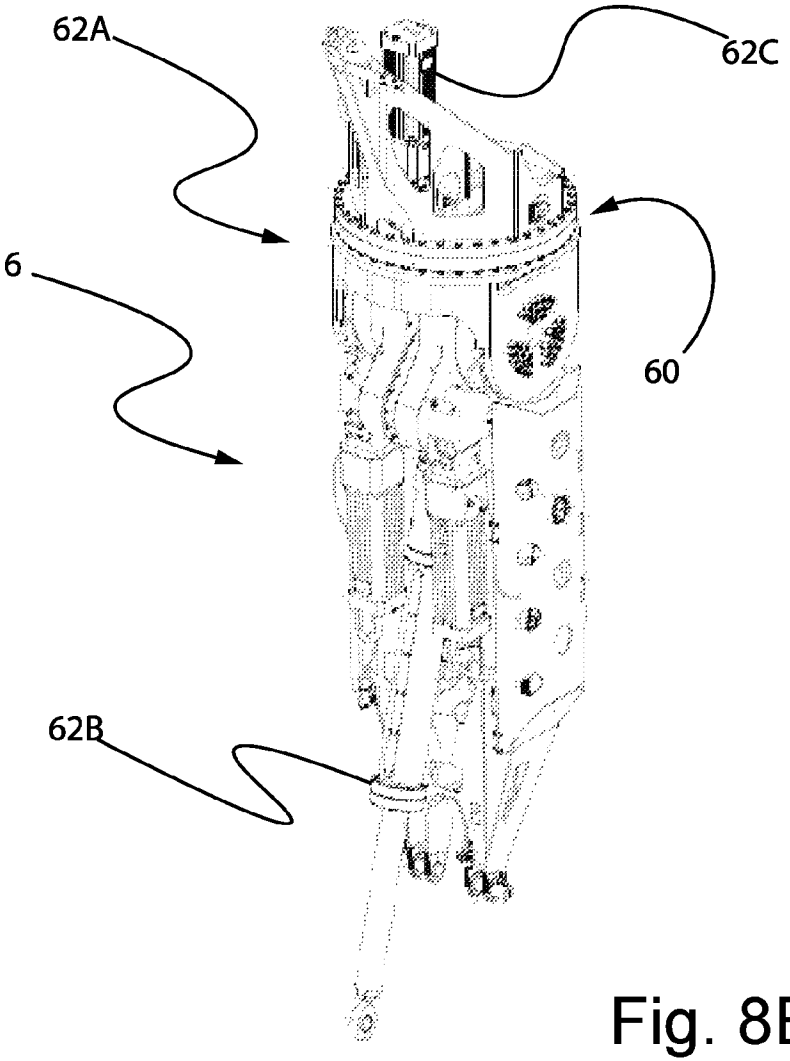
FIGS. 8A and 8B show further details of the preferred embodiment of the manipulator; in particular.
Figure 8A:
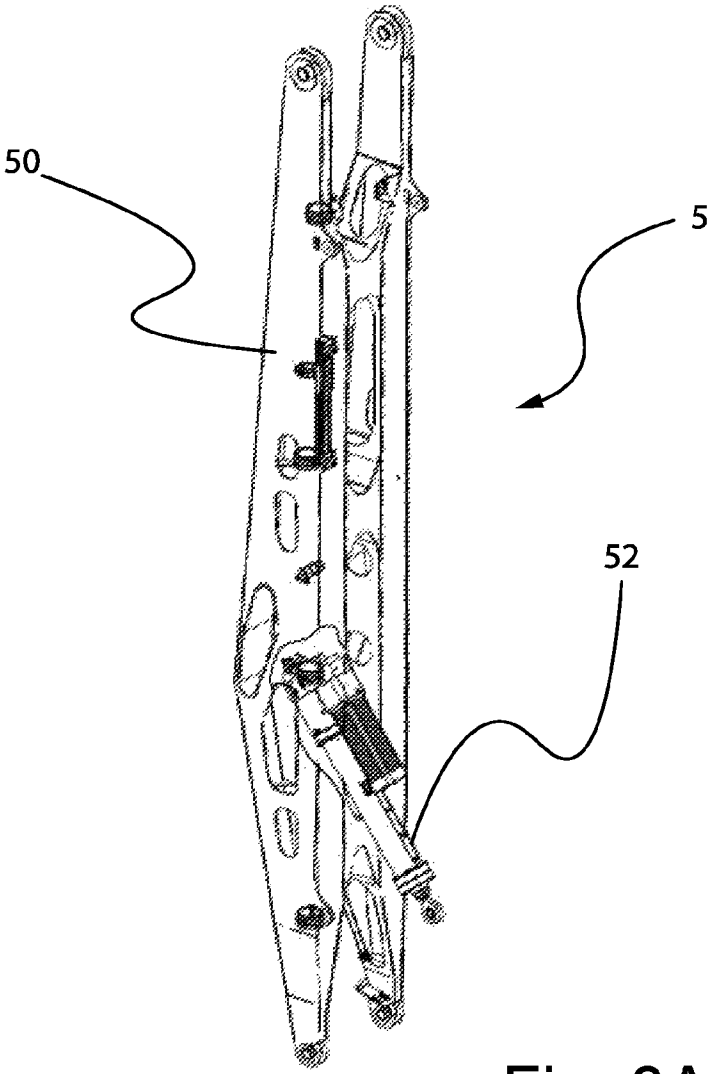

FIGS. 8A and 8B show further details of the preferred embodiment of manipulator 3.

FIG. 8A shows a perspective view of articulated arm 5 with the second actuator 52. In this figure one can see monolithic body 50 adapted to be constrained, at its ends, to carriage 4 and to robotic apparatus 6, respectively. The figure shows the locations where the actuators (51, 52) of articulated arm 5 are connected. The construction details of articulated arm 5 can be understood by a person skilled in the art without needing any further explanation.

FIG. 8B shows a perspective view of robotic apparatus 6 with the second electric actuator 62B, slewing ring 60 and the third electric actuator 62C. In this figure one can see the first electric actuator 62A that can cause the manipulation head to rotate about a horizontal axis, on top of which slewing ring 60 and the portion connected to articulated arm 5 are located. Said electric actuator 62C is adapted to cause said manipulation head 7 to rotate about a first vertical axis by means of said slewing ring 60, since said third actuator 62C is adapted to rotatably drive a rack for rotating slewing ring 60. The construction details of robotic apparatus 6 can be understood by a person skilled in the art without needing any further explanation.

Figure 9B:
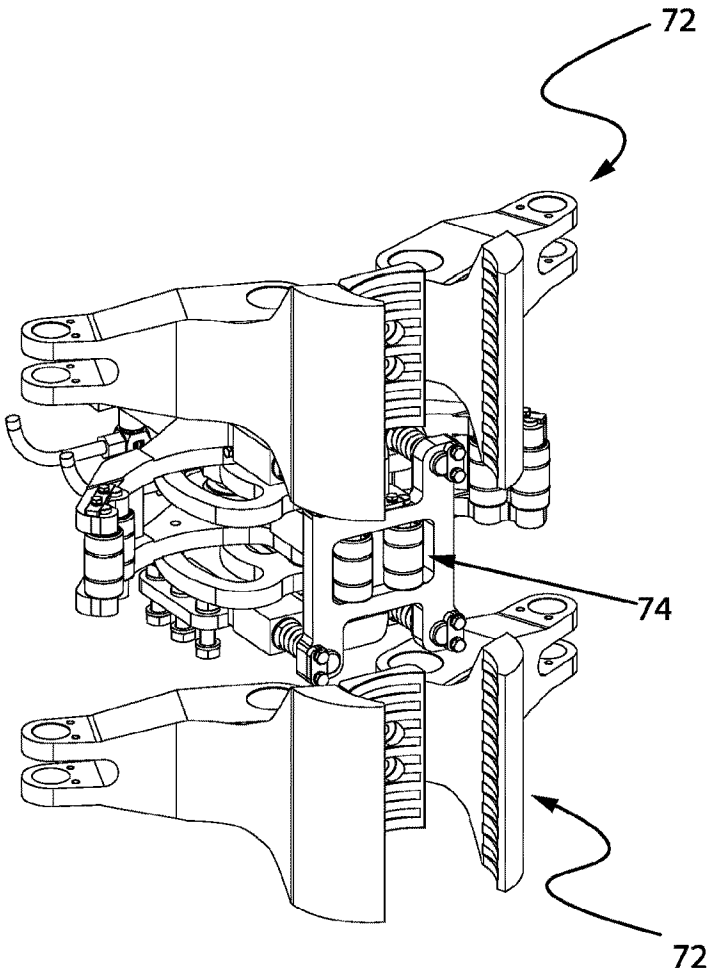
FIGS. 9A and 9B show further details of preferred embodiments of the manipulation head; in particular.
Figure 9A:
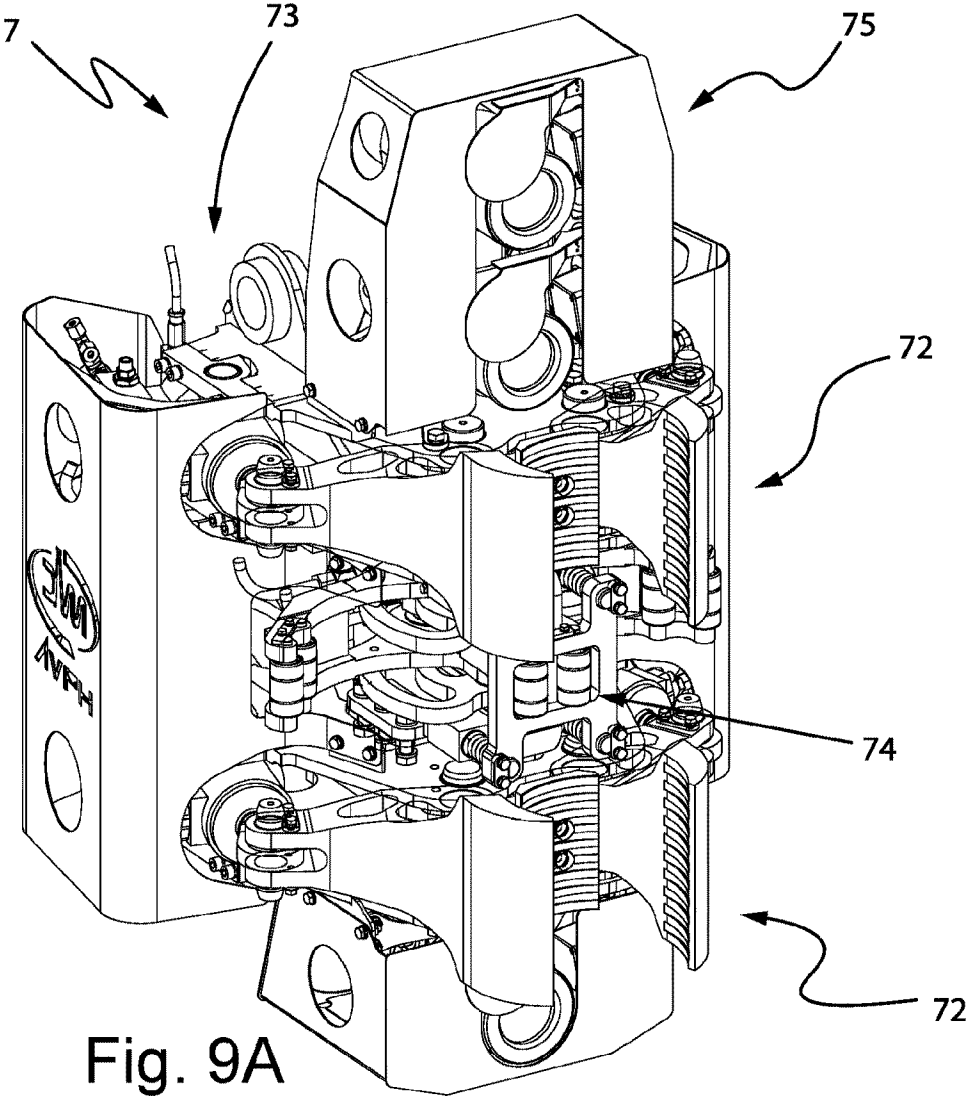

FIGS. 9A and 9B show further details of a preferred embodiment of manipulation head 7.

FIG. 9A shows a front view of manipulation head 7 according to a first embodiment thereof. In this figure one can see the compact shape of manipulation head 7, which advantageously comprises a compact, high-power, hydraulic, and hence reliable, handling device 73 for handling clamps 72. The figure shows the advantageous arrangement of the two clamps 72, between which a rotation system 74 is positioned. Manipulation head 7 further comprises safety system 75, which includes optical sensors adapted to detect the correct position of clamps 72 relative to drilling elements "P". Preferably, such sensors of safety system 75 are optical sensors, preferably at least three of them, adapted to identify the correct position of the clamps 72 with respect to drilling element "P", in order to avoid gripping the connection portion or tool joint.

FIG. 9B shows a second embodiment of clamps 72 and of rotation system 74. Clamps 72 shown in FIG. 9B are adapted to grasp drilling elements "P" having a smaller diameter than those that can be grasped by clamps 72 shown in FIG. 9A. Also rotation system 74 has been suitably modified to properly work with smaller-diameter drilling elements "P". Both embodiments of clamps 72 and of rotation system 74 are advantageously designed to act upon two areas of drilling element "P", between which said rotation system 74 is interposed in order to improve the grip on drilling element "P" while at the same time allowing drilling element "P" to rotate freely when assembling or disassembling a stand "S" of drilling elements "P".

Preferably, said clamps 72 are provided with load cells, preferably suitably arranged to obtain a triangle of forces, for the purpose of determining if the drilling element "P" has been grasped correctly and if the load is balanced, so as to provide an indication about the inclination of manipulation head 7.

FIG. 10A shows drill floor 13 and stabilization system 8 in one possible operating configuration. This figure shows the reduced space occupation of stabilization system 8 on drill floor 13 in this configuration of drilling rig 1. Said stabilization system 8 has positioned itself with the arms (81, 82) extended across drill floor 13.

More in general, said stabilization system 8 cooperates with manipulator 3, thus constituting the manipulation system, so as to facilitate the handling of drilling elements "P" from said fingerboard 14 towards a well, e.g. a main well or well center "H" or a secondary well "M", and vice versa.

In FIG. 10B stabilization system 8 is still extended across drill floor 13, as shown in FIG. 10A, for the purpose of causing no hindrance.

FIGS. 10C and 10D show stabilization system 8 in different operating configurations, wherein it cooperates with manipulator 3 in order to handle one or more drilling elements "P", preferably assembled into stands "S".

In general, multifunction manipulator 3 according to the present invention can be used for handling drilling elements "P", whether individual elements or multiple elements assembled into stands "S", during different operating phases of a drilling rig 1, i.e. both during the actual drilling phase, in order to quickly set drilling elements "P" into a position accessible to drill head 15, and during a preliminary phase, in order to assemble together several drilling elements "P" to create a stand "S" of drilling elements "P". For example, manipulator 3 allows moving one or more tubular drilling elements "P" from the horizontal position to the vertical position, and vice versa; assembling and disassembling drilling elements "P" to create stands "S" during the off-line phases of the rig; moving drilling elements "P" and/or stands "S" from a well (H, M) to a fingerboard 14, and vice versa, or between wells (H, M).

Manipulator 3 advantageously makes it possible to assemble and disassemble drilling elements "P" at a distance from the activities going on at well center "H", without interfering with the drilling operation being executed by drill head 15. This activity carried out by manipulator 3 reduces the time necessary for assembling and disassembling a stand "S" of drilling elements "P", thus favourably affecting the overall costs incurred for operating drilling rig 1. Moreover, the handling of drilling elements "P" is effected by manipulator 3 and/or by the manipulation system through the execution of semiautomatic and automatic procedures, resulting in higher safety and predictability and keeping the crew out of the operating area of the manipulation system.

The present invention makes it possible to reduce the number of manipulators comprised in a drilling rig 1, thus simplifying the management of drilling rig 1, even when using stands "S" of drilling elements made up of two or more drilling elements "P".

Multifunction manipulator 3 according to the present invention permits reducing the number and contribution of human operators on both drill floor 13 and fingerboard 14. This increases the safety of drilling rig 1, reducing the number of accidents and making the handling of drilling elements "P" safer, so that human presence can be eliminated from both drill floor 13 and fingerboard 14.

The manipulation system according to the present invention permits reducing those undesired effects that typically come from handling drilling elements "P" assembled into stands "S", and in particular any oscillatory effects that may cause accidents on drill floor 13 and on fingerboard 14. In addition, the present invention permits increasing the speed at which drilling elements "P" are moved, thus reducing the downtime of drilling rig 1, particularly during the drilling phase. In fact, the manipulation system according to the present invention is designed for reducing the risk of triggering an oscillatory motion of drilling elements "P" and for quickly damping any oscillation, so that it will not cause any damage to the manipulation system itself.

The present invention makes it possible to increase the automation of drilling rigs 1, thus eliminating the risk of accidents that may involve human operators, in addition to reducing the downtime and simplifying the management of the drilling rig.

Manipulator 3 according to the present invention ensures a high level of precision in controlling every movement. The sensors and actuators are integrated into manipulator 3 and efficiently cooperate within the architecture of the management program of manipulator 3, while high-performance reducers and servocontrols ensure even movements and reliable operation.

Any alternative embodiments not described in detail herein, as well as any combinations of technical features which can be easily inferred from the present description by a person skilled in the art, should be considered to fall within the scope of the present invention.

REFERENCE NUMERALS

Drilling rig 1
Control unit 10
Mast 12
Guides 121
Drill floor 13
Fingerboard 14
Housing 142
Drill head 15
Lifting device 16
Manipulator 3
Control system 32
Sensors 33
Carriage 4
Sliding block 41
Hoisting system 42
Winch 420
Pulley 422
Pin 423
Load cell 424
Emergency braking system 43
Articulated arm 5
Body 50
First actuator 51
Second actuator 52
Robotic apparatus 6
Slewing ring 60
First electric actuator 62A
Second electric actuator 62B
Third electric actuator 62C
Manipulation head 7
Clamp 72
Handling device 73
Rotation system 74
Safety system 75
Stabilization system 8
Slide 80
First arm 81
Second arm 82
Roller 83
Actuators 84
Guide 85
Well center H
Secondary well M
Drilling elements P
Stand S
Second axis X
Third axis Y
First axis Z

The invention claimed is:

1. A multifunction manipulator for manipulating drilling elements in a drilling rig for assembling, disassembling and moving a stand of drilling elements;

said manipulator comprising:
- a carriage:
- an articulated arm comprising at least two operating configurations;
- a robotic apparatus;
- a manipulation head;
- a control system;

said robotic apparatus being adapted to move said manipulation head with at least three degrees of freedom;

said manipulator being configured to move said manipulation head with at least five degrees of freedom;

said carriage comprising:
- at least one sliding block;
- a pulley-type hoisting system comprising a winch;
- an emergency braking system adapted to prevent the carriage from moving in the event of a malfunction of the hoisting system;

said pulley-type hoisting system being adapted to cause said carriage to slide vertically along a first axis parallel to a longitudinal extension of a mast in the drilling rig;

said at least one sliding block of the carriage is adapted to slide along guides on the mast;

said guides are positioned in a front part of the mast and are configured to allow the carriage to slide along the entire longitudinal extension of said mast;

said guides are parallel to second guides, the second guides permit moving a drill head of the drilling rig along said mast;

said carriage, said hoisting system and said guides are configured to be free of interfering with the drill head;

said emergency braking system is adapted to act on said guides on the mast;

said articulated arm having a monolithic body and being constrained, at one end thereof, to said carriage, so that said articulated arm is rotatable about a horizontal axis; and being constrained, at a second end thereof, to a first end of said robotic apparatus, so that said articulated arm is rotatable about another horizontal axis;

said manipulation head being connected to the second end of the robotic apparatus;

said articulated arm comprising:
- a first actuator adapted to move the articulated arm to allow moving the robotic apparatus along at least one second axis perpendicular to said first axis, to achieve said at least two operating configurations;
- a second actuator adapted to move the articulated arm to allow keeping the first end of the robotic apparatus in line with an axis parallel to said first axis;
- said articulated arm and said robotic apparatus comprising only electric actuators;
- said control system being adapted to independently control all the electric actuators in said articulated arm and in said robotic apparatus.

2. The manipulator according to claim 1, wherein:

said first actuator is a linear actuator constrained, at a first end thereof, to the body of the articulated arm; and constrained, at the second end thereof, to the carriage;

said second actuator is a linear actuator constrained, at a first end thereof, to the body of the articulated arm; and constrained, at the second end thereof, to the first end of the robotic apparatus.

3. The manipulator according to claim 1, wherein said robotic apparatus comprises, at said first end thereof, a slewing ring allowing the robotic apparatus to rotate about a vertical axis;

said second actuator of the articulated arm being configured to keep said slewing ring in line with an axis parallel to said first axis.

4. The manipulator according to claim 1, wherein said robotic apparatus comprises:

a first electric actuator adapted to cause said manipulation head to rotate about a first horizontal axis;

a second electric linear actuator adapted to cause said manipulation head to oscillate relative to a second horizontal axis, wherein said second horizontal axis is parallel to said first horizontal axis;

a third electric actuator adapted to cause said manipulation head to rotate about a first vertical axis, through a slewing ring in the robotic apparatus at said first end of the robotic apparatus.

5. The manipulator according to claim 1, wherein said control system is adapted to independently control movements of said carriage, said articulated arm and said robotic apparatus.

6. The manipulator according to claim 1, wherein said manipulation head comprises:

at least one clamp adapted to grasp, hold and release different types of drilling elements;

at least one rotation system adapted to permit rotation of the drilling elements.

7. The manipulator according to claim 6, wherein said manipulation head comprises:

a hydraulic handling device for handling said clamps;

a safety system, comprising a plurality of sensors, adapted to identify correct positioning of said clamp relative to the drilling element.

8. The manipulator according to claim 1, wherein:

said pulley-type hoisting system comprising a pulley disposed on said carriage, said pulley comprising a pin carrying a load cell.

9. A manipulation system for manipulating drilling elements in a drilling rig in the absence of human operators on a drill floor and/or on a fingerboard of said drilling rig;

said manipulation system comprising: a stabilization system adapted to slide along a guide disposed on said drill floor; and a multifunction manipulator according to claim 1;

said stabilization system being adapted to cooperate with said manipulator for handling one or more drilling elements.

10. The manipulation system according to claim 9, wherein:

said stabilization system comprises two independent arms adapted to grasp and release a first end of at least one drilling element or of a stand of drilling elements;

said manipulator being adapted to grasp, hold and release a second end of the same at least one drilling element or of the same stand of drilling elements.

11. The manipulation system according to claim 9, comprising a control unit adapted to control relative motion of said manipulator and said stabilization system to obtain mutually coordinated movements.

12. A drilling rig comprising:

a substructure adapted to be set at ground level where drilling will take place;

a mast extending along a vertical axis;

a drill floor set at a predefined height from the ground level, on top of the substructure, from which said mast extends;

a drill head adapted to slide along said mast; said mast comprising, at a predefined height above the drill floor, a fingerboard configured to house a plurality of drilling elements;

a lifting device adapted to move the drilling elements from the ground level to the drill floor, and vice versa;

the manipulator according to claim 7.

13. A drilling rig comprising:

a substructure adapted to be set at ground level where drilling will take place;

a mast extending along a vertical axis;

a drill floor set at a predefined height from the ground level, on top of the substructure, from which said mast extends;

a drill head adapted to slide along said mast; said mast comprising, at a predefined height above the drill floor, a fingerboard configured to house a plurality of drilling elements;

a lifting device adapted to move the drilling elements from the ground level to the drill floor, and vice versa;

the manipulation system according to claim 9.

* * * * *